US010299063B2

(12) United States Patent
Chon et al.

(10) Patent No.: US 10,299,063 B2
(45) **Date of Patent: *May 21, 2019**

(54) METHOD AND DEVICE FOR RENDERING ACOUSTIC SIGNAL, AND COMPUTER-READABLE RECORDING MEDIUM

(71) Applicant: SAMSUNG ELECTRONICS CO., LTD., Suwon-si (KR)

(72) Inventors: Sang-Bae Chon, Suwon-si (KR); Sun-min Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/004,774

(22) Filed: Jun. 11, 2018

(65) Prior Publication Data

US 2018/0295460 A1 Oct. 11, 2018

Related U.S. Application Data

(63) Continuation of application No. 15/322,051, filed as application No. PCT/KR2015/006601 on Jun. 26, 2015, now Pat. No. 10,021,504.

(Continued)

(51) Int. Cl.

| | |
|---|---|
| ***H04S 7/00*** | (2006.01) |
| ***H04S 3/00*** | (2006.01) |
| ***H04S 5/00*** | (2006.01) |

(52) U.S. Cl.

CPC ..... *H04S 7/302* (2013.01); *H04S 3/008* (2013.01); *H04S 5/005* (2013.01);

(Continued)

(58) Field of Classification Search

CPC ..... H04S 3/008; H04S 2400/01; H04S 7/302; H04S 2400/03; H04S 5/005; H04S 2420/05

(Continued)

(56) References Cited

U.S. PATENT DOCUMENTS

| | | | |
|---|---|---|---|
| 9,451,378 | B2 | 9/2016 | Park |
| 2008/0212786 | A1 | 9/2008 | Park |

(Continued)

FOREIGN PATENT DOCUMENTS

| | | | |
|---|---|---|---|
| CN | 101257740 | A | 9/2008 |
| CN | 102165797 | A | 8/2011 |

(Continued)

OTHER PUBLICATIONS

Communication issued by the Japanese Patent Office dated Mar. 6, 2018 in counterpart Japanese Application No. 2016-575113.

(Continued)

*Primary Examiner* — Paul Kim

(74) *Attorney, Agent, or Firm* — Sughrue Mion, PLLC

(57) ABSTRACT

When a channel signal, such as a 22.2 channel signal, is rendered into a 5.1 channel signal, a three-dimensional (3D) audio may be reproduced by using a two-dimensional (2D) output channel, however, when an elevation angle of an input channel is different from a standard elevation angle, if elevation rendering parameters according to the standard elevation angle are used, distortion may occur in a sound image. In order to solve the aforementioned problem according to the related art and to prevent front-back confusion due to a surround output channel, an embodiment of the present invention provides a method of rendering an audio signal, the method including receiving a multichannel signal including a plurality of input channels to be converted to a plurality of output channels; adding a preset delay to a frontal height (Continued)

input channel so as to allow each of the plurality of output channels to provide a sound image having an elevation at a reference elevation angle; changing, based on the added delay, an elevation rendering parameter with respect to the frontal height input channel; and preventing front-back confusion by generating, based on the changed elevation rendering parameter, an elevation-rendered surround output channel delayed with respect to the frontal height input channel.

11 Claims, 18 Drawing Sheets

Related U.S. Application Data

(60) Provisional application No. 62/017,499, filed on Jun. 26, 2014.

(52) U.S. Cl.
CPC ..... *H04S 2400/01* (2013.01); *H04S 2400/03* (2013.01); *H04S 2420/05* (2013.01)

(58) Field of Classification Search
USPC ..... 381/303
See application file for complete search history.

(56) References Cited

U.S. PATENT DOCUMENTS

| | | | | |
|---|---|---|---|---|
| 2011/0249819 | A1 | 10/2011 | Davis | |
| 2012/0008789 | A1* | 1/2012 | Kim | H04S 3/002 381/17 |

FOREIGN PATENT DOCUMENTS

| | | | |
|---|---|---|---|
| CN | 102611966 | A | 7/2012 |
| CN | 103081512 | A | 5/2013 |
| JP | 2013533703 | A | 8/2013 |
| JP | 5410682 | B2 | 2/2014 |
| KR | 10-2013-0080819 | A | 7/2013 |
| WO | 2010080451 | A1 | 7/2010 |
| WO | 2013103256 | A1 | 7/2013 |
| WO | 2014041067 | A1 | 3/2014 |
| WO | 2014058275 | A1 | 4/2014 |
| WO | 2014/157975 | A1 | 10/2014 |
| WO | 2015/147619 | A1 | 10/2015 |

OTHER PUBLICATIONS

Communication dated Sep. 22, 2015 issued by the International Searching Authority in counterpart International Application No. PCT/KR2015/006601 (PCT/ISA/210/220/237).

Victoria Evelkin et al; "Effect of Latency Time in Higher Frequencies on Sound Localization"; In: IEEE 27th Convention of Electrical and Electronics Engineers in Israel; Nov. 14-17, 2012; pp. 1-4; 6 pgs. total.

Hyun Jo et al; "Applying spectral cues to generate elevated sound sources displayed via ear-level loudspeakers"; Inter-noise 2011; pp. 1-6.

Communication issued by the European Patent Office dated Nov. 16, 2017 in counterpart European Application No. 15811229.2.

Communication issued by the Canadian Intellectual Property Office dated Nov. 24, 2017 in counterpart Canadian Patent Application No. 2,935,674.

"Report ITU-R BS.2159-4: Multichannel sound technology in home and broadcasting applications", BS Series, Broadcasting service (sound), May 2012, total 54 pages, XP055095534, Retrieved from the Internet: URL:http://www.itu.int/dms_pub/itu-r/opb/rep/R-REP-BS.2159-4-2012-PDF-E.pdf [retrieved on Jan. 9, 2014).

Chinese Office Action corresponding to Chinese Patent Application No. 201580045447.3, dated Feb. 2, 2018.

Communication dated Oct. 12, 2018, from the State Intellectual Property Office of People's Republic of China in counterpart Application No. 201580045447.3.

* cited by examiner

METHOD AND DEVICE FOR RENDERING ACOUSTIC SIGNAL, AND COMPUTER-READABLE RECORDING MEDIUM

CROSS-REFERENCE TO RELATED APPLICATIONS

This application is a continuation of U.S. application Ser. No. 15/322,051, filed on Dec. 23, 2016, which is a National Stage Entry of PCT/KR2015/006601, filed on Jun. 26, 2015, which claims the benefit of U.S. Provisional Application No. 62/017,499, filed on Jun. 26, 2014, in the U.S. Patent and Trademark Office, the disclosures of which are incorporated by reference herein in their entireties.

TECHNICAL FIELD

The present invention relates to a method and apparatus for rendering an audio signal, and more particularly, to a rendering method and apparatus for further accurately representing a position of a sound image and a timbre by modifying an elevation panning coefficient or an elevation filter coefficient, when an elevation of an input channel is higher or lower than an elevation according to a standard layout.

BACKGROUND ART 3D audio means audio that allows a listener to have an immersive feeling by reproducing not only an elevation of audio and a tone color but also reproducing a direction or a distance, and to which spatial information is added, wherein the spatial information makes the listener, who is not located in a space where an audio source occurred, have a directional perception, a distance perception, and a spatial perception.

When a channel signal, such as a 22.2 channel signal, is rendered into a 5.1 channel signal, a three-dimensional (3D) audio may be reproduced by using a two-dimensional (2D) output channel, however, when an elevation angle of an input channel is different from a standard elevation angle, if an input signal is rendered by using rendering parameters determined according to the standard elevation angle, distortion may occur in a sound image.

DETAILED DESCRIPTION OF THE INVENTION

Technical Problem

As described above, when a multichannel signal, such as a 22.2 channel signal, is rendered into a 5.1 channel signal, a three-dimensional (3D) surround sound may be reproduced by using a two-dimensional (2D) output channel, however, when an elevation angle of an input channel is different from a standard elevation angle, if an input signal is rendered by using rendering parameters determined according to the standard elevation angle, distortion may occur in a sound image.

In order to solve the aforementioned problem according to the related art, the present invention is provided to decrease distortion of a sound image even if an elevation of an input channel is higher or lower than a standard elevation.

Technical Solution

In order to achieve the objective, the present invention includes embodiments below.

According to an embodiment of the present invention, there is provided a method of rendering an audio signal, the method including receiving a multichannel signal including a plurality of input channels to be converted to a plurality of output channels; adding a predetermined delay to a frontal height input channel so as to allow the plurality of output channels to provide elevated sound image at a reference elevation angle; modifying, based on the added delay, elevation rendering parameters with respect to the frontal height input channel; and preventing front-back confusion by generating, based on the modified elevation rendering parameters, an elevation-rendered surround output channel delayed with respect to the frontal height input channel.

The plurality of output channels may be horizontal channels.

The elevation rendering parameters may include at least one of panning gains and elevation filter coefficients.

The frontal height input channel may include at least one of CH_U_L030, CH_U_R030, CH_U_L045, CH_U_R045, and CH_U_000 channels.

The surround output channel may include at least one of CH_M_L110 and CH_M_R110 channels.

The predetermined delay may be determined based on a sampling rate.

According to another embodiment of the present invention, there is provided an apparatus for rendering an audio signal, the apparatus including a receiving unit configured to receive a multichannel signal including a plurality of input channels to be converted to a plurality of output channels; a rendering unit configured to add a predetermined delay to a frontal height input channel so as to allow the plurality of output channels to provide elevated sound image at a reference elevation angle, and to modify, based on the added delay, elevation rendering parameters with respect to the frontal height input channel; and an output unit configured to prevent front-back confusion by generating, based on the modified elevation rendering parameters, an elevation-rendered surround output channel delayed with respect to the frontal height input channel.

The plurality of output channels may be horizontal channels.

The elevation rendering parameters may include at least one of panning gains and elevation filter coefficients.

The frontal height input channel may include at least one of CH_U_L030, CH_U_R030, CH_U_L045, CH_U_R045, and CH_U_000 channels.

The frontal height channel may include at least one of CH_U_L030, CH_U_R030, CH_U_L045, CH_U_R045, and CH_U_000 channels.

The predetermined delay may be determined based on a sampling rate.

According to another embodiment of the present invention, there is provided a method of rendering an audio signal, the method including receiving a multichannel signal including a plurality of input channels to be converted to a plurality of output channels; obtaining elevation rendering parameters with respect to a height input channel so as to allow the plurality of output channels to provide elevated sound image at a reference elevation angle; and updating the elevation rendering parameters with respect to a height input channel having a predetermined elevation angle rather than the reference elevation angle, wherein the updating of the elevation rendering parameters includes updating elevation panning gains for panning a height input channel at a top front center to a surround output channel.

The plurality of output channels may be horizontal channels.

The elevation rendering parameters may include at least one of the elevation panning gains and an elevation filter coefficients.

The updating of the elevation rendering parameters may include updating the elevation panning gains, based on the reference elevation angle and the predetermined elevation angle.

When the predetermined elevation angle is less than the reference elevation angle, updated elevation panning gains from among the updated elevation panning gains which is to be applied to an ipsilateral output channel of an output channel having the predetermined elevation angle may be greater than the elevation panning gains before the updating, and a total sum of squares of the updated elevation panning gains to be respectively applied to the plurality of input channels may be 1.

When the predetermined elevation angle is greater than the reference elevation angle, an updated elevation panning gain from among the updated elevation panning gains which is to be applied to an ipsilateral output channel of an output channel having the predetermined elevation angle may be less than the elevation panning gains before the updating, and a total sum of squares of the updated elevation panning gains to be respectively applied to the plurality of input channels may be 1.

According to another embodiment of the present invention, there is provided an apparatus for rendering an audio signal, the apparatus including a receiving unit configured to receive a multichannel signal including a plurality of input channels to be converted to a plurality of output channels; and a rendering unit configured to obtain elevation rendering parameters with respect to a height input channel so as to allow the plurality of output channels to provide elevated sound image at a reference elevation angle, and to update the elevation rendering parameters with respect to a height input channel having a predetermined elevation angle rather than the reference elevation angle, wherein the updated elevation rendering parameters includes elevation panning gains for panning a height input channel at a top front center to a surround output channel.

The plurality of output channels may be horizontal channels.

The elevation rendering parameters may include at least one of the elevation panning gains and an elevation filter coefficient.

The updated elevation rendering parameters may include the elevation panning gains updated based on the reference elevation angle and the predetermined elevation angle.

When the predetermined elevation angle is less than the reference elevation angle, updated elevation panning gains from among the updated elevation panning gains which is to be applied to an ipsilateral output channel of an output channel having the predetermined elevation angle may be greater than the elevation panning gains before the update, and a total sum of squares of the updated elevation panning gains to be respectively applied to the plurality of input channels may be 1.

When the predetermined elevation angle is greater than the reference elevation angle, updated elevation panning gains from among the updated elevation panning gains which is to be applied to an ipsilateral output channel of an output channel having the predetermined elevation angle may be less than the elevation panning gains that are not updated, and a total sum of squares of the updated elevation panning gains to be respectively applied to the plurality of input channels may be 1.

According to another embodiment of the present invention, there is provided a method of rendering an audio signal, the method including receiving a multichannel signal including a plurality of input channels to be converted to a plurality of output channels; obtaining elevation rendering parameters with respect to a height input channel so as to allow the plurality of output channels to provide elevated sound image at a reference elevation angle; and updating the elevation rendering parameters with respect to a height input channel having a predetermined elevation angle rather than the reference elevation angle, wherein the updating of the elevation rendering parameters includes obtaining elevation panning gains updated with respect to a frequency range including a low frequency band, based on a location of the height input channel.

The updated elevation panning gains may be panning gains with respect to a rear height input channel.

The plurality of output channels may be horizontal channels.

The elevation rendering parameters may include at least one of the elevation panning gains and an elevation filter coefficients.

The updating of the elevation rendering parameters may include applying a weight to the elevation filter coefficients, based on the reference elevation angle and the predetermined elevation angle.

When the predetermined elevation angle is less than the reference elevation angle, the weight may be determined so that an elevation filter characteristic may be smoothly exhibited, and when the predetermined elevation angle is greater than the reference elevation angle, the weight may be determined so that the elevation filter characteristic may be sharply exhibited.

The updating of the elevation rendering parameters may include updating the elevation panning gains, based on the reference elevation angle and the predetermined elevation angle.

When the predetermined elevation angle is less than the reference elevation angle, an updated elevation panning gain from among the updated elevation panning gains which is to be applied to an ipsilateral output channel of an output channel having the predetermined elevation angle may be greater than the elevation panning gains before the updating, and a total sum of squares of the updated elevation panning gains to be respectively applied to the plurality of input channels may be 1.

When the predetermined elevation angle is greater than the reference elevation angle, an updated elevation panning gain from among the updated elevation panning gains which is to be applied to an ipsilateral output channel of an output channel having the predetermined elevation angle may be less than the elevation panning gains before the updating, and a total sum of squares of the updated elevation panning gains to be respectively applied to the plurality of input channels may be 1.

According to another embodiment of the present invention, there is provided an apparatus for rendering an audio signal, the apparatus including a receiving unit configured to receive a multichannel signal including a plurality of input channels to be converted to a plurality of output channels; and a rendering unit configured to obtain elevation rendering parameters with respect to a height input channel so as to allow the plurality of output channels to provide elevated sound image at a reference elevation angle, and to update the elevation rendering parameters with respect to a height input channel having a predetermined elevation angle rather than the reference elevation angle, wherein the updated elevation rendering parameters include elevation panning gains updated with respect to a frequency range including a low frequency band, based on a location of the height input channel.

The updated elevation panning gains may be panning gains with respect to a rear height input channel.

The plurality of output channels may be horizontal channels.

The elevation rendering parameters may include at least one of the elevation panning gains and an elevation filter coefficients.

The updated elevation rendering parameters may include the elevation filter coefficients to which a weight is applied based on the reference elevation angle and the predetermined elevation angle.

When the predetermined elevation angle is less than the reference elevation angle, the weight may be determined so that an elevation filter characteristic may be smoothly exhibited, and when the predetermined elevation angle is greater than the reference elevation angle, the weight may be determined so that the elevation filter characteristic may be sharply exhibited.

The updated elevation rendering parameters may include the elevation panning gains updated based on the reference elevation angle and the predetermined elevation angle.

When the predetermined elevation angle is less than the reference elevation angle, updated elevation panning gains from among the updated elevation panning gains which is to be applied to an ipsilateral output channel of an output channel having the predetermined elevation angle may be greater than the elevation panning gains before the update, and a total sum of squares of the updated elevation panning gains to be respectively applied to the plurality of input channels may be 1.

When the predetermined elevation angle is greater than the reference elevation angle, updated elevation panning gains from among the plurality of updated elevation panning gains which is to be applied to an ipsilateral output channel of an output channel having the predetermined elevation angle may be less than the elevation panning gains before the updating, and a total sum of squares of the updated elevation panning gains to be respectively applied to the plurality of input channels may 1.

According to another embodiment of the present invention, there are provided a program for executing the aforementioned methods and a computer-readable recording medium having recorded thereon the program.

In addition, there are provided another method, another system, and a computer-readable recording medium having recorded thereon a computer program for executing the method.

Advantageous Effects

According to the present invention, a 3D audio signal may be rendered in a manner that distortion of a sound image is decreased even if an elevation of an input channel is higher or lower than a standard elevation. In addition, according to the present invention, a front-back confusion phenomenon due to surround output channels may be prevented.

BEST MODE

Figure 1:
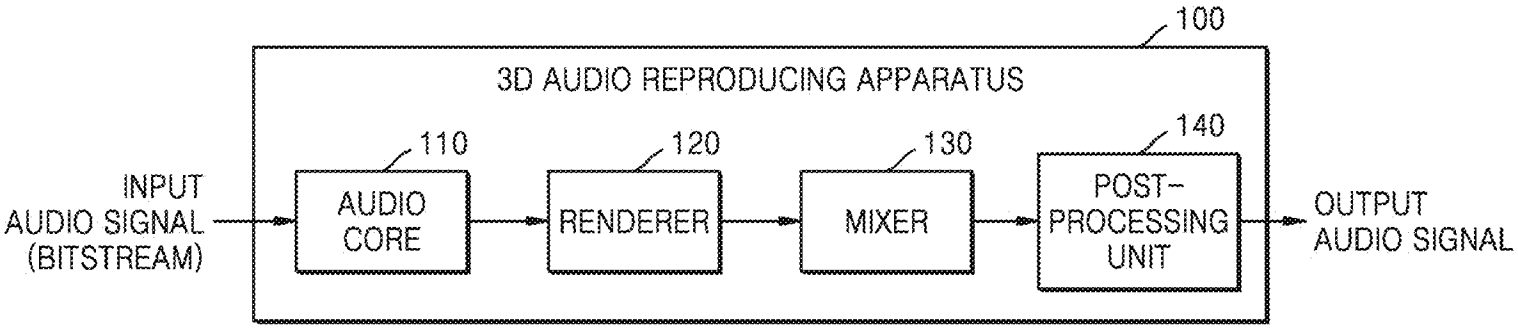
FIG. 1 is a block diagram illustrating an internal structure of a 3D audio reproducing apparatus, according to an embodiment.

In order to achieve the objective, the present invention includes embodiments below.

According to an embodiment, there is provided a method of rendering an audio signal, the method including receiving a multichannel signal including a plurality of input channels to be converted to a plurality of output channels; adding a predetermined delay to a frontal height input channel so as to allow the plurality of output channels to provide elevated sound image at a reference elevation angle; modifying, based on the added delay, elevation rendering parameters with respect to the frontal height input channel; and preventing front-back confusion by generating, based on the modified elevation rendering parameters, an elevation-rendered surround output channel delayed with respect to the frontal height input channel.

Mode of the Invention

The detailed descriptions of the invention are referred to with the attached drawings illustrating particular embodiments of the invention. These embodiments are provided so that this disclosure will be thorough and complete, and will fully convey the concept of the invention to one of ordinary skill in the art. It will be understood that various embodiments of the invention are different from each other and are not exclusive with respect to each other.

For example, a particular shape, a particular structure, and a particular feature described in the specification may be changed from an embodiment to another embodiment without departing from the spirit and scope of the invention. Also, it will be understood that a position or layout of each element in each embodiment may be changed without departing from the spirit and scope of the invention. Therefore, the detailed descriptions should be considered in a descriptive sense only and not for purposes of limitation and the scope of the invention is defined not by the detailed description of the invention but by the appended claims, and all differences within the scope will be construed as being included in the present invention.

Like reference numerals in the drawings denote like or similar elements throughout the specification. In the following description and the attached drawings, well-known functions or constructions are not described in detail since they would obscure the present invention with unnecessary detail. Also, like reference numerals in the drawings denote like or similar elements throughout the specification.

Hereinafter, the present invention will be described in detail by explaining exemplary embodiments of the invention with reference to the attached drawings. The invention may, however, be embodied in many different forms, and should not be construed as being limited to the embodiments set forth herein; rather, these embodiments are provided so that this disclosure will be thorough and complete, and will fully convey the concept of the invention to those of ordinary skill in the art.

Throughout the specification, when an element is referred to as being "connected to" or "coupled with" another element, it can be "directly connected to or coupled with" the other element, or it can be "electrically connected to or coupled with" the other element by having an intervening element interposed therebetween. Also, when a part "includes" or "comprises" an element, unless there is a particular description contrary thereto, the part can further include other elements, not excluding the other elements.

Hereinafter, the exemplary embodiments of the present invention will be described with reference to the attached drawings.

FIG. 1 is a block diagram illustrating an internal structure of a 3D audio reproducing apparatus, according to an embodiment.

A 3D audio reproducing apparatus 100 according to an embodiment may output a multichannel audio signal in which a plurality of input channels are mixed to a plurality of output channels for reproduction. Here, if the number of output channels is less than the number of input channels, the input channels are downmixed to correspond to the number of output channels.

3D audio means audio that allows a listener to have an immersive feeling by reproducing not only an elevation of audio and a tone color but also reproducing a direction or a distance, and to which spatial information is added, wherein the spatial information makes the listener, who is not located in a space where an audio source occurred, have a directional perception, a distance perception, and a spatial perception.

In the descriptions below, output channels of an audio signal may mean the number of speakers through which audio is output. The higher the number of output channels, the higher the number of speakers through which audio is output. The 3D audio reproducing apparatus 100 according to an embodiment may render and mix the multichannel audio signal to an output channel for reproduction, so that the multichannel audio signal having the large number of input channels may be output and reproduced in an environment where the number of output channels is small. In this regard, the multichannel audio signal may include a channel capable of outputting an elevated sound.

The channel capable of outputting an elevated sound may indicate a channel capable of outputting an audio signal via a speaker positioned above a head of a listener so as to make the listener feel elevated. A horizontal channel may indicate a channel capable of outputting an audio signal via a speaker positioned on a horizontal plane with respect to the listener.

The aforementioned environment where the number of output channels is small may indicate an environment that does not include an output channel capable of outputting the elevated sound and in which audio may be output via a speaker arranged on the horizontal plane.

Also, in the descriptions below, a horizontal channel may indicate a channel including an audio signal to be output via a speaker positioned on the horizontal plane. An overhead channel may indicate a channel including an audio signal to be output via a speaker that is not positioned on the horizontal plane but is positioned on an elevated plane so as to output an elevated sound.

Referring to FIG. 1, the 3D audio reproducing apparatus 100 according to an embodiment may include an audio core 110, a renderer 120, a mixer 130, and a post-processing unit 140.

According to an embodiment, the 3D audio reproducing apparatus 100 may output may render, mix, and output a multichannel input audio signal to an output channel for reproduction. For example, the multichannel input audio signal may be a 22.2 channel signal, and the output channel for reproduction may be 5.1 or 7.1 channels. The 3D audio reproducing apparatus 100 may perform rendering by setting output channels to be respectively mapped to channels of the multichannel input audio signal, and may mix rendered audio signals by mixing signals of the channels respectively mapped to channels for reproduction and outputting a final signal.

An encoded audio signal is input in the form of bitstream to the audio core 110, and the audio core 110 selects a decoder appropriate for a format of the encoded audio signal and decodes the input audio signal.

The renderer 120 may render the multichannel input audio signal to multichannel output channels according to channels and frequencies. The renderer 120 may perform three-dimensional (3D) rendering and two-dimensional (2D) rendering on each of signals according to overhead channels and horizontal channels. A configuration of a render and a rendering method will be described in detail with reference to FIG. 2.

The mixer 130 may mix the signals of the channels respectively mapped to the horizontal channels, by the renderer 120, and may output the final signal. The mixer 130 may mix the signals of the channels according to each of predetermined periods. For example, the mixer 130 may mix the signals of each of the channels according to one frame.

The mixer 130 according to an embodiment may perform mixing, based on a power value of the signals respectively rendered to the channels for reproduction. In other words, the mixer 130 may determine amplitude of the final signal or a gain to be applied to the final signal, based on the power value of the signals respectively rendered to the channels for reproduction.

The post-processing unit 140 performs a dynamic range control with respect to a multiband signal and binauralizing on the output signal from the mixer 130, according to each reproducing apparatus (a speaker, a headphone, etc.). An output audio signal output from the post-processing unit 140 may be output via an apparatus such as a speaker, and may be reproduced in a 2D or 3D manner after processing of each configuration element.

The 3D audio reproducing apparatus 100 according to an embodiment shown in FIG. 1 is shown with respect to a configuration of its audio decoder, and an additional configuration is skipped.

Figure 2:
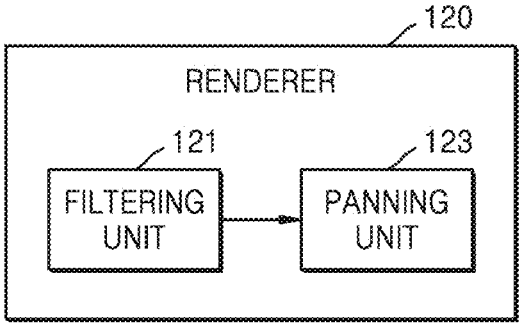
FIG. 2 is a block diagram illustrating a configuration of a renderer in the 3D audio reproducing apparatus, according to an embodiment.

FIG. 2 is a block diagram illustrating a configuration of a renderer in the 3D audio reproducing apparatus, according to an embodiment.

The renderer 120 includes a filtering unit 121 and a panning unit 123.

The filtering unit 121 may compensate for a tone color or the like of a decoded audio signal, according to a location, and may filter an input audio signal by using a Head-Related Transfer Function (HRTF) filter.

In order to perform 3D rendering on an overhead channel, the filtering unit 121 may render the overhead channel, which has passed the HRTF filter, by using different methods according to frequencies.

The HRTF filter makes 3D audio recognizable according to a phenomenon in which not only a simple path difference such as an Interaural Level Differences (ILD) between both ears, Interaural Time Differences (ITD) between both ears with respect to an audio arrival time, or the like but also complicated path properties such as diffraction at a head surface, reflection due to an earflap, or the like are changed according to a direction in which audio arrives. The HRTF filter may process audio signals included in the overhead channel by changing a sound quality of an audio signal, so as to make the 3D audio recognizable.

The panning unit 123 obtains a panning coefficient to be applied to each of frequency bands and each of channels and applies the panning coefficient, so as to pan the input audio signal with respect to each of output channels. To perform panning on an audio signal means to control magnitude of a signal applied to each output channel, so as to render an audio source at a particular location between two output channels. The panning coefficient may be referred to as the panning gain.

The panning unit 123 may perform rendering on a low frequency signal from among overhead channel signals by using an add-to-the-closest-channel method, and may perform rendering on a high frequency signal by using a multichannel panning method. According to the multichannel panning method, a gain value that is set to differ in channels to be rendered to each of channel signals is applied to signals of each of channels of a multichannel audio signal, so that each of the signals may be rendered to at least one horizontal channel. The signals of each channel to which the gain value is applied may be synthesized via mixing and may be output as a final signal.

The low frequency signals are highly diffractive, even if the channels of the multichannel audio signal are not divided and rendered to several channels according to the multichannel panning method but are rendered to only one channel, the low frequency signals may have sound qualities that are similarly recognized by a listener. Therefore, the 3D audio reproducing apparatus 100 according to an embodiment may render the low frequency signals by using the add-to-the-closest-channel method and thus may prevent sound quality deterioration that may occur when several channels are mixed to one output channel. That is, when several channels are mixed to one output channel, a sound quality may be amplified or decreased due to interference between channel signals and thus may deteriorate, and in this regard, the sound quality deterioration may be prevented by mixing one channel to one output channel.

According to the add-to-the-closest-channel method, channels of the multichannel audio signal may not be rendered to several channels but may each be rendered to a closest channel from among channels for reproduction.

In addition, the 3D audio reproducing apparatus 100 may expand a sweet spot without the sound quality deterioration by performing rendering by using different methods according to frequencies. That is, the low frequency signals that are highly diffractive are rendered according to the add-to-the-closest-channel method, so that the sound quality deterioration occurring when several channels are mixed to one output channel may be prevented. The sweet spot means a predetermined range where the listener may optimally listen to 3D audio without distortion.

When the sweet spot is large, the listener may optimally listen to the 3D audio without distortion in a large range, and when the listener is not located in the sweet spot, the listener may listen to audio in which a sound quality or a sound image is distorted.

Figure 3:
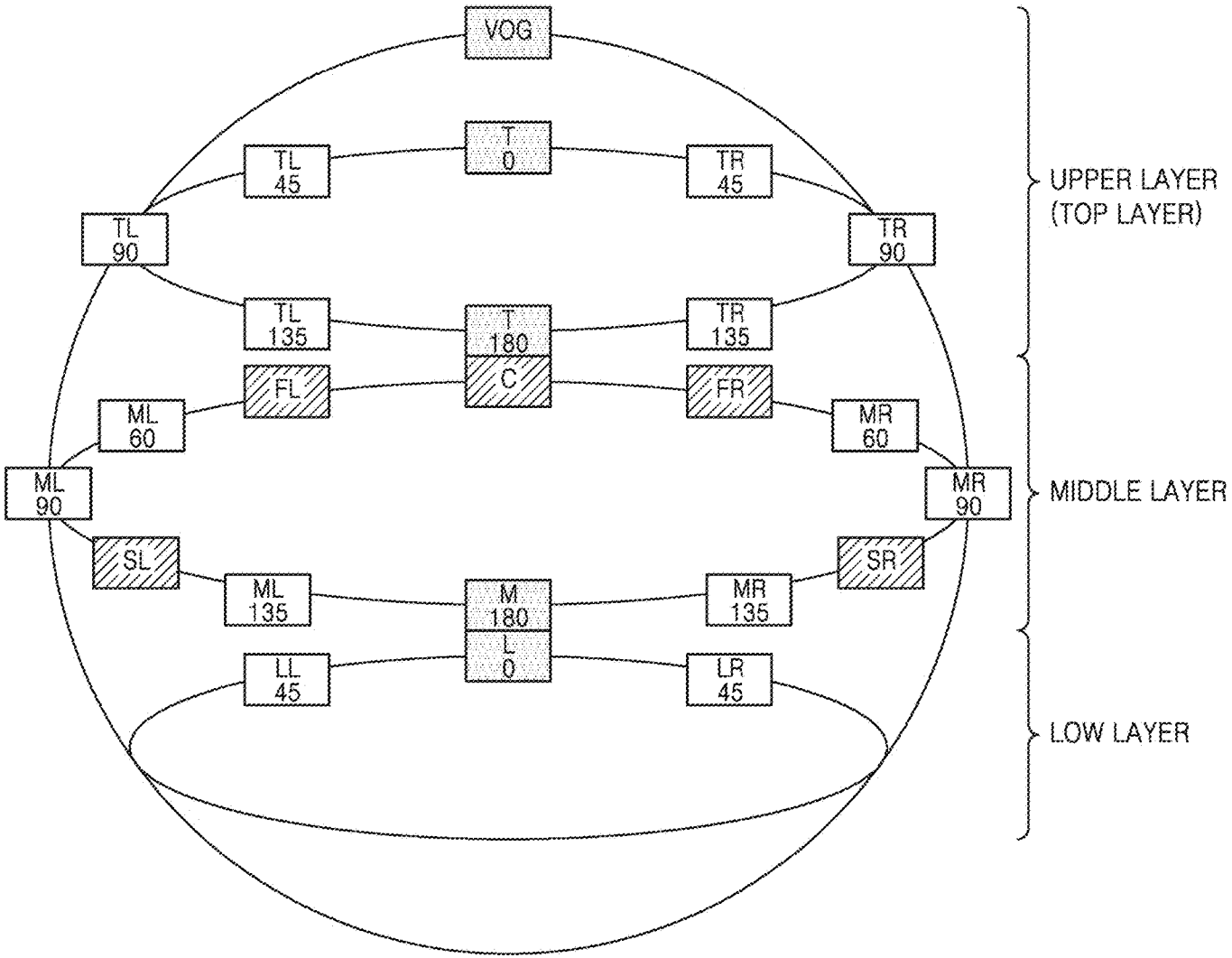
FIG. 3 illustrates a layout of channels when a plurality of input channels are downmixed to a plurality of output channels, according to an embodiment.

FIG. 3 illustrates a layout of channels when a plurality of input channels are downmixed to a plurality of output channels, according to an embodiment.

A technology has been being developed to provide 3D audio with a 3D surround image so as to provide live and immersive feelings, such as a 3D image, which are same as reality or are further exaggerated. 3D audio means an audio signal having elevation and spatial perception with respect to sound, and at least two loudspeakers, i.e., output channels, are required so as to reproduce the 3D audio. In addition, except for binaural 3D audio using an HRTF, the large number of output channels is required so as to further accurately realize elevation, a directional perception, and a spatial perception with respect to sound.

Therefore, followed by a stereo system having 2 channel output, various multichannel systems such as a 5.1 channel system, the Auro 3D system, the Holman 10.2 channel system, the ETRI/Samsung 10.2 channel system, the NHK 22.2 channel system, and the like are provided and developed.

FIG. 3 illustrates an example in which a 22.2 channel 3D audio signal is reproduced via a 5.1 channel output system.

The 5.1 channel system is a general name of a 5 channel surround multichannel sound system, and is commonly spread and used as an in-house home theater and a sound system for theaters. All 5.1 channels include a front left (FL) channel, a center (C) channel, a front right (FR) channel, a surround left (SL) channel, and a surround right (SR) channel. As shown in FIG. 3, since outputs from 5.1 channels are all present on a same plane, the 5.1 channel system corresponds to a 2D system in a physical manner, and in order for the 5.1 channel system to reproduce a 3D audio signal, a rendering process has to be performed to apply a 3D effect to a signal to be reproduced.

The 5.1 channel system is widely used in various fields including movies, DVD videos, DVD audios, Super Audio Compact Discs (SACDs), digital broadcasting, and the like. However, even if the 5.1 channel system provides an improved spatial perception, compared to the stereo system, the 5.1 channel system has many limits in forming a larger hearing space. In particular, a sweet spot is narrowly formed, and a vertical sound image having an elevation angle cannot be provided, such that the 5.1 channel system may not be appropriate for a large-scale hearing space such as a theater.

The 22.2 channel system presented by the NHK consists of three layers of output channels as shown in FIG. 3. An upper layer 310 includes Voice of God (VOG), T0, T180, TL45, TL90, TL135, TR45, TR90, and TR45 channels. Here, an index T at the front of a name of each channel means an upper layer, an index L or R means a left side or a right side, and a number at the rear means an azimuth angle from a center channel. The upper layer is commonly called the top layer.

The VOG channel is a channel that is above a head of a listener, has an elevation angle of 90 degrees, and does not have an azimuth angle. When a location of the VOG channel is slightly changed, the VOG channel has the azimuth angle and has an elevation angle that is not 90 degrees, and in this case, the VOG channel may no longer be a VOG channel.

A middle layer 320 is on a same plane as the 5.1 channels, and includes ML60, ML90, ML135, MR60, MR90, and MR135 channels, in addition to output channels of the 5.1 channels. Here, an index M at the front of a name of each channel means a middle layer, and a number at the rear means an azimuth angle from a center channel.

A low layer 330 includes L0, LL45, and LR45 channels. Here, an index L at the front of a name of each channel means a low layer, and a number at the rear means an azimuth angle from a center channel.

In the 22.2 channels, the middle layer is called a horizontal channel, and the VOG, T0, T180, T180, M180, L, and C channels whose azimuth angle is 0 degree or 180 degrees are called vertical channels.

When a 22.2 channel input signal is reproduced via the 5.1 channel system, the most general scheme is to distribute signals to channels by using a downmix formula. Alternatively, by performing rendering to provide a virtual elevation, the 5.1 channel system may reproduce an audio signal having an elevation.

Figure 4:
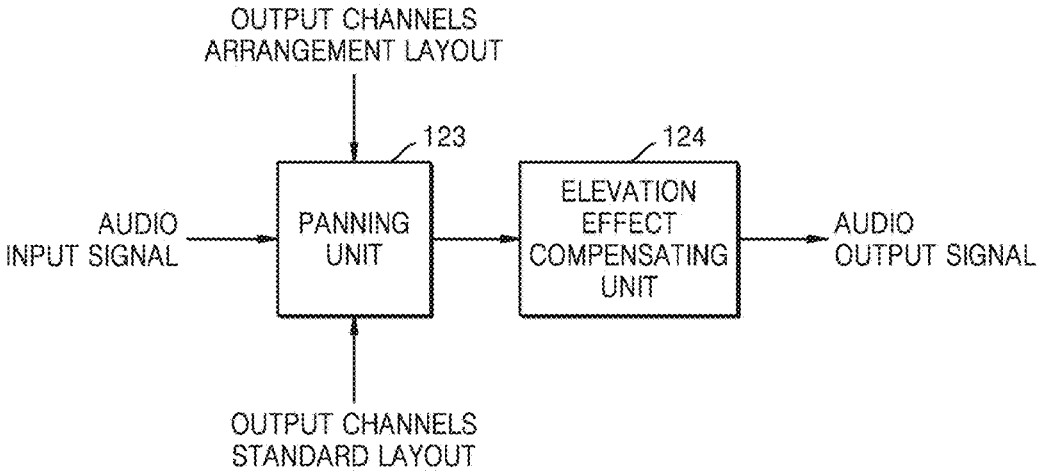
FIG. 4 illustrates a panning unit in an example where a positional deviation occurs between a standard layout and an arrangement layout of output channels, according to an embodiment.

FIG. 4 illustrates a panning unit in an example where a positional deviation occurs between a standard layout and an arrangement layout of output channels, according to an embodiment.

When a multichannel input audio signal is reproduced by using the number of output channels smaller than the number of channels of an input signal, an original sound image may be distorted, and in order to compensate for the distortion, various techniques are being studied.

General rendering techniques are designed to perform rendering, provided that speakers, i.e., output channels, are arranged according to the standard layout. However, when the output channels are not arranged to accurately match the standard layout, distortion of a location of a sound image and distortion of a sound quality occur.

The distortion of the sound image widely includes distortion of the elevation, distortion of a phase angle, or the like that are not sensitive in a relatively low level. However, due to a physical characteristic of a human body where both ears are located in left and right sides, if sound images of left-center-right sides are changed, the distortion of the sound image may be sensitively perceived. In particular, a sound image of a front side may be further sensitively perceived.

Therefore, as shown in FIG. 3, when the 22.2 channels are realized via the 5.1 channels, it is particularly required not to change sound images of the VOG, T0, T180, T180, M180, L, and C channels located at 0 degree or 180 degrees, rather than left and right channels.

When an audio input signal is panned, basically, two processes are performed.

The first process corresponds to an initializing process in which a panning coefficient with respect to an input multichannel signal is calculated according to a standard layout of output channels. In the second process, a calculated coefficient is modified based on a layout with which the output channels are actually arranged. After the panning coefficient modifying process is performed, a sound image of an output signal may be present at a more accurate location.

Therefore, in order for the panning unit 123 to perform processing, information about the standard layout of the output channels and information about the arrangement layout of the output channels are required, in addition to the audio input signal. In a case where the C channel is rendered from the L channel and the R channel, the audio input signal indicates an input signal to be reproduced via the C channel, and an audio output signal indicates modified panning signals output from the L channel and the R channel according to the arrangement layout.

When an elevation deviation is present between the standard layout and the arrangement layout of the output channels, a 2D panning method considering only an azimuth deviation does not compensate for an effect due to the elevation deviation. Therefore, if the elevation deviation is present between the standard layout and the arrangement layout of the output channels, an elevation increase effect due to the elevation deviation has to be compensated for by using an elevation effect compensating unit 124 of FIG. 4.

Figure 5:
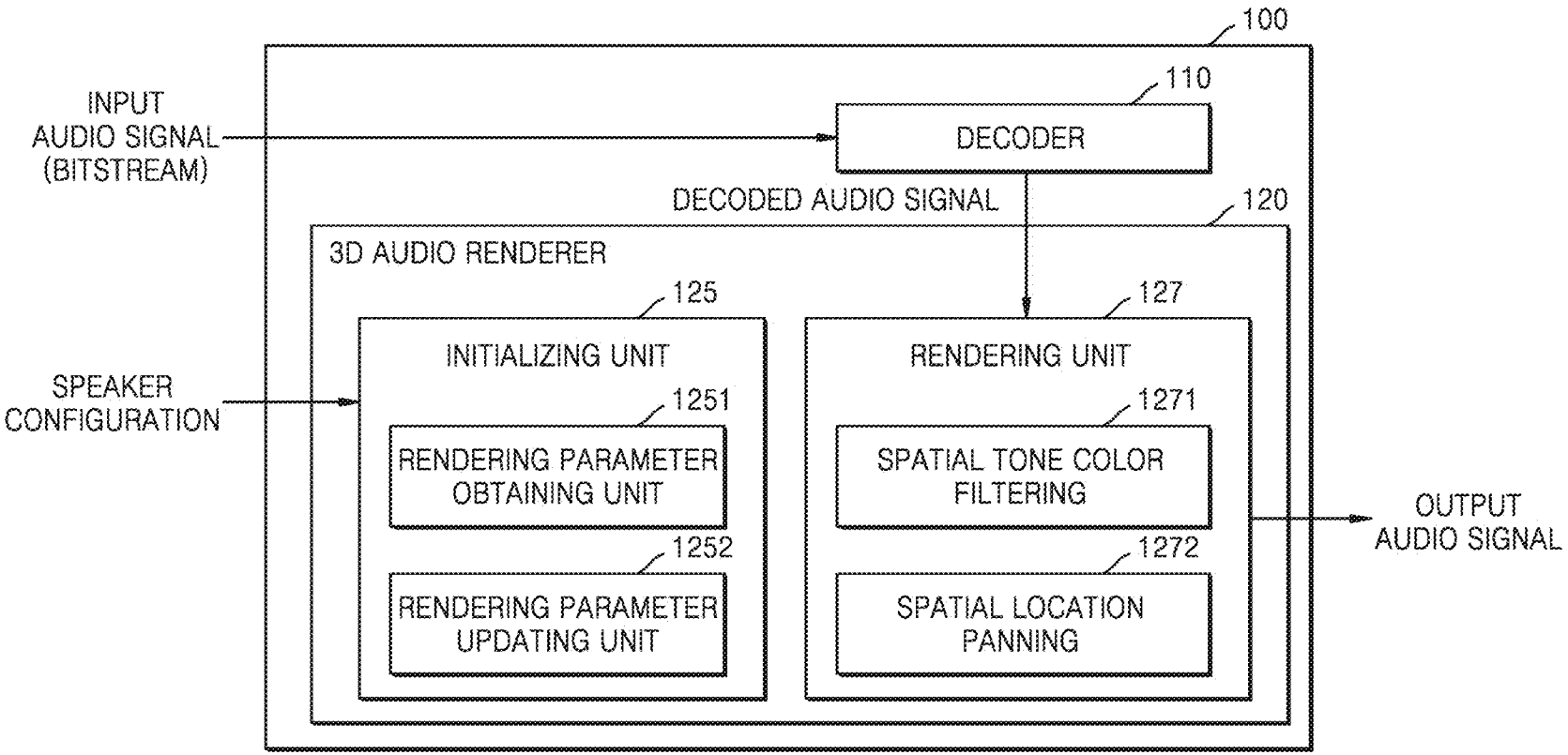
FIG. 5 is a block diagram illustrating configurations of a decoder and a 3D audio renderer in the 3D audio reproducing apparatus, according to an embodiment.

FIG. 5 is a block diagram illustrating configurations of a decoder and a 3D audio renderer in the 3D audio reproducing apparatus, according to an embodiment.

Referring to FIG. 5, the 3D audio reproducing apparatus 100 according to an embodiment is shown with respect to configurations of a decoder 110 and a 3D audio renderer 120, and other configurations are omitted.

An audio signal input to the 3D audio reproducing apparatus 100 is an encoded signal that is input in a bitstream form. The decoder 110 selects a decoder appropriate for a format of the encoded audio signal, decodes the input audio signal, and transmits the decoded audio signal to the 3D audio renderer 120.

The 3D audio renderer 120 consists of an initializing unit 125 configured to obtain and update a filter coefficient and a panning coefficient, and a rendering unit 127 configured to perform filtering and panning.

The rendering unit 127 performs filtering and panning on the audio signal transmitted from the decoder 110. A filtering unit 1271 processes information about a location of audio and thus makes the rendered audio signal reproduced at a desired location, and a panning unit 1272 processes information about a sound quality of audio and thus makes the rendered audio signal have a sound quality mapped to the desired location.

The filtering unit 1271 and the panning unit 1272 perform similar functions as those of the filtering unit 121 and the panning unit 123 described with reference to FIG. 2. However, the filtering unit 121 and the panning unit 123 of FIG. 2 are displayed in simple forms where an initializing unit, or the like to obtain a filter coefficient and a panning coefficient may be omitted.

Here, the filter coefficient for performing filtering and the panning coefficient for performing panning are provided from the initializing unit 125. The initializing unit 125 consists of an elevation rendering parameter obtaining unit 1251 and an elevation rendering parameter updating unit 1252.

The elevation rendering parameter obtaining unit 1251 obtains an initial value of an elevation rendering parameter by using a configuration and arrangement of an output channel, i.e., a loudspeaker. Here, the initial value of the elevation rendering parameter may be calculated based on a configuration of an output channel according to the standard layout and a configuration of an input channel according to elevation rendering setting, or an initial value previously stored according to a mapping relationship between input/output channels is read. The elevation rendering parameter may include the filter coefficient to be used by the elevation rendering parameter obtaining unit 1251 or the panning coefficient to be used by the elevation rendering parameter updating unit 1252.

However, as described above, an elevation setting value for rendering an elevation may have a deviation with respect to setting of the input channel. In this case, if a fixed elevation setting value is used, it is difficult to achieve an objective of virtual rendering for similarly three-dimensionally reproducing an original 3D audio signal by using an output channel different from an input channel.

For example, when an elevation is too high, a sound image is small and a sound quality deteriorates, and when the elevation is too low, it is difficult to feel an effect of virtual rendering. Accordingly, it is required to adjust the elevation according to a user's setting or a virtual rendering level appropriate for the input channel.

The elevation rendering parameter updating unit 1252 updates initial values of the elevation rendering parameter, which were obtained by the elevation rendering parameter obtaining unit 1251, based on elevation information of the input channel or a user-set elevation. Here, if a speaker layout of an output channel has a deviation with respect to the standard layout, a process for compensating for an effect due to the difference may be added. The deviation of the output channel may include deviation information according to a difference between elevation angles or azimuth angles.

An output audio signal that is filtered and panned by the rendering unit 127 using the elevation rendering parameter obtained and updated by the initializing unit 125 is reproduced via speakers corresponding to the output channels, respectively.

Figure 6:
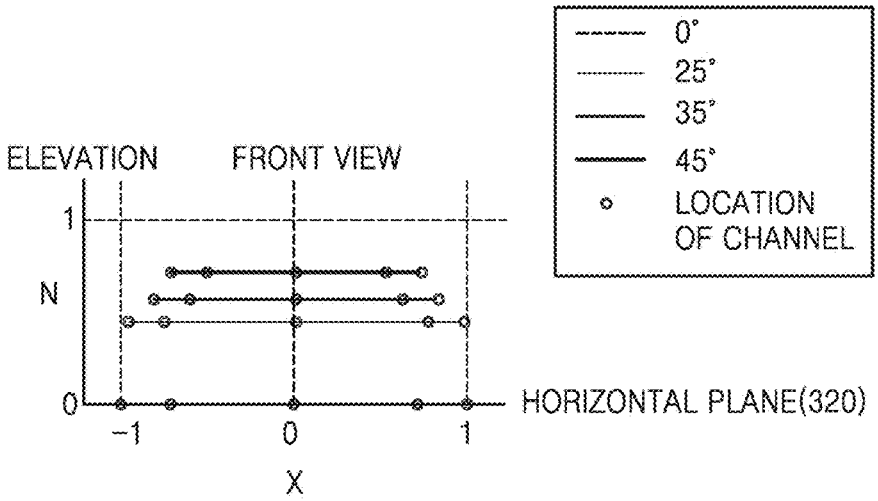
FIGS. 6 through 8 illustrate layouts of upper layer channels according to elevations of upper layers in a channel layout, according to an embodiment.
Figure 7:
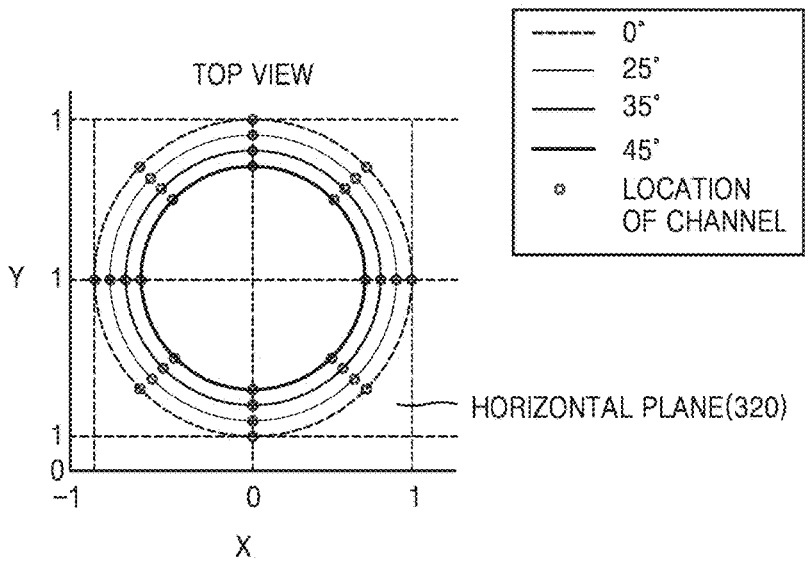
Figure 8:
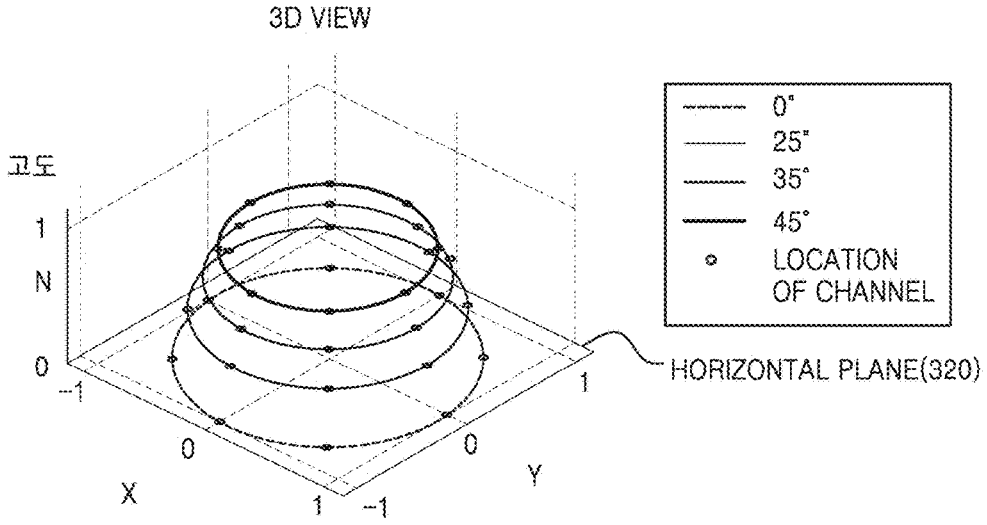

FIGS. 6 through 8 illustrate layouts of upper layer channels according to elevations of upper layers in a channel layout, according to an embodiment.

When it is assumed that an input channel signal is a 22.2 channel 3D audio signal and is arranged according to the layout shown in FIG. 3, an upper layer of an input channel has a layout shown in FIG. 4, according to elevation angles. Here, it is assumed that the elevation angles are 0 degree, 25 degrees, 35 degrees, and 45 degrees, and a VOG channel corresponding to 90 degrees of an elevation angle is omitted. Upper layer channels having an elevation angle of 0 degree are present on a horizontal plane (the middle layer 320).

FIG. 6 illustrates a front view layout of upper layer channels.

Referring to FIG. 6, each of eight upper layer channels has an azimuth angle difference of 45 degrees, thus, when the upper layer channels are viewed at a front side with respect to a vertical channel axis, in six channels excluding a TL90 channel and a TR90 channel, each two channels, i.e., a TL45 channel and a TL135 channel, a T0 channel and a T180 channel, and a TR45 channel and a TR135 channel, are overlapped. This is more apparent compared to FIG. 8.

FIG. 7 illustrates a top view layout of the upper layer channels. FIG. 8 illustrates a 3D view layout of the upper layer channels. It is possible to see that the eight upper layer channels are arranged at regular intervals while each having an azimuth angle difference of 45 degrees.

When content to be reproduced with 3D audio via elevation rendering is fixed to have an elevation angle of 35 degrees, the elevation rendering with the elevation angle of 35 degrees may be performed on all input audio signals, so that an optimal result will be achieved.

However, an elevation angle may be differently applied to a 3D audio of content, depending on a plurality of pieces of content, and as shown in FIGS. 6 through 8, according to an elevation of each of channels, locations and distances of the channels vary, and signal characteristics due to the variance also vary.

Therefore, when virtual rendering is performed at a fixed elevation angle, distortion of a sound image occurs , and in order to achieve an optimal rendering performance, it is necessary to perform rendering, in consideration of an elevation angle of an input 3D audio signal, i.e., an elevation angle of an input channel.

Figure 9:
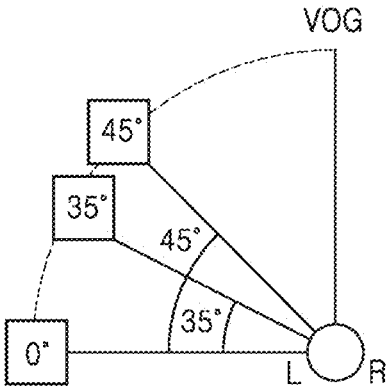
FIGS. 9 through 11 illustrate variation of a sound image and variation of an elevation filter, according to elevations of a channel, according to an embodiment.
Figure 10:
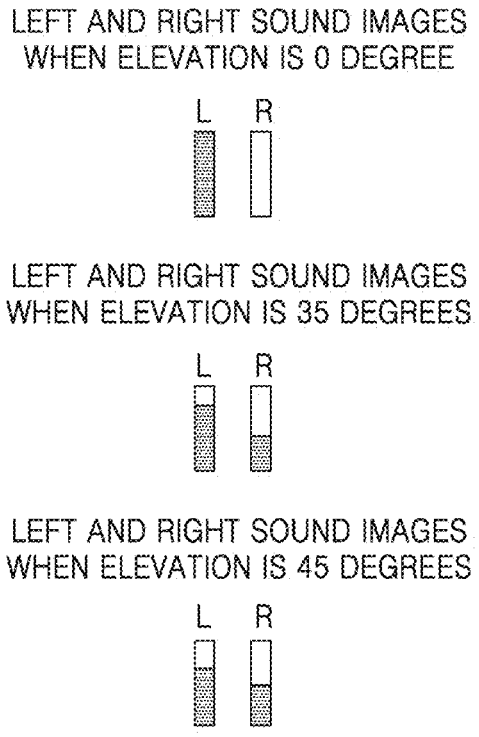
Figure 11:
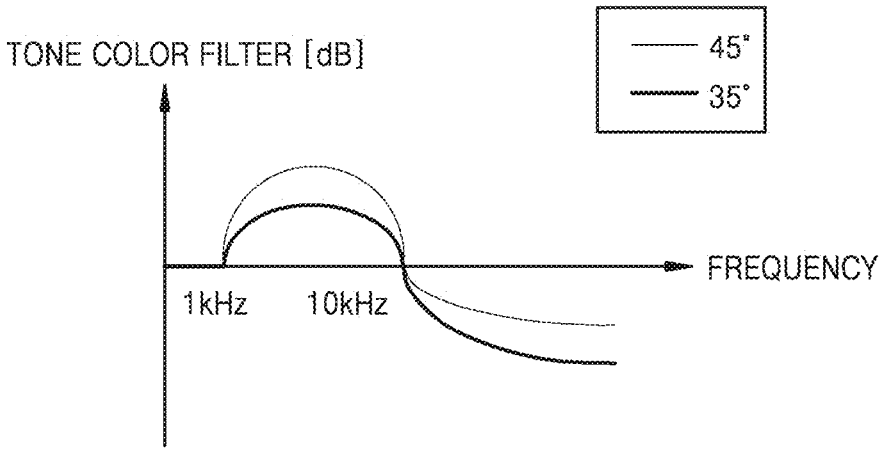

FIGS. 9 through 11 illustrate variation of a sound image and variation of an elevation filter, according to elevations of a channel, according to an embodiment.

FIG. 9 illustrates locations of channels when elevations of height channels are 0 degree, 35 degrees, and 45 degrees, respectively. FIG. 9 is taken at a rear of a listener, and each of the illustrated channels is a ML90 channel or a TL90 channel. When an elevation angle is 0 degree, a channel is present on a horizontal plane and corresponds to the ML90 channel, and when the elevation angle is 35 degrees and 45 degrees, channels are upper layer channels and correspond to the TL90 channel.

FIG. 10 illustrates a signal difference between left and right ears of a listener, when audio signals are output from respective channels located as shown in FIG. 9.

When the audio signal is output from an ML90 having no elevation angle, theoretically, the audio signal is perceived only via the left ear and is not perceived via the right ear.

However, as an elevation is increased, a difference between audio signals perceived via the left ear and the right ear is decreased, and when an elevation angle of a channel is increased and thus becomes 90 degrees, the channel becomes a VOG channel above a head of the listener, thus, both ears perceive a same audio signal.

Therefore, variation with respect to an audio signal perceived by both ears according to elevation angles is as shown FIG. 7B.

With respect to an audio signal perceived via the left ear when the elevation angle is 0 degree, only the left ear perceives the audio signal whereas the right ear does not perceive the audio signal. In this case, Interaural Level Differences (ILD) and Interaural Time Differences (ITD) are maximal, and the listener perceives the audio signal as a sound image of the ML90 channel existing on a left horizontal plane channel.

With respect to a difference between audio signals perceived via the left and right ears when the elevation angle is 35 degrees and audio signals perceived via the left and right ears when the elevation angle is 45 degree, since the elevation angle is increased, the difference between the audio signals perceived via the left and right ears is decreased, and due to the difference, the listener may feel a difference of elevations in the output audio signal.

An output signal from a channel with the elevation angle of 35 degrees is characterized in a large sound image, a large sweet spot, and a natural sound quality, compared to an output signal from a channel with the elevation angle of 45 degrees, and the output signal from the channel with the elevation angle of 45 degrees is characterized in a small sound image, a small sweet spot, and a sound field feeling providing an intense immersive feeling, compared to the output signal from the channel with the elevation angle of 35 degrees.

As described above, as the elevation angle is increased, the elevation is also increased, so that the immersive feeling becomes intense, but a width of an audio signal is decreased. This is because, as the elevation angle is increased, a physical location of a channel becomes closer and thus is close to the listener.

Therefore, an update of a panning coefficient according to the variance of the elevation angle is determined below. As the elevation angle is increased, the panning coefficient is updated to make the sound image larger, and as the elevation angle is decreased, the panning coefficient is updated to make the sound image smaller.

For example, it is assumed that a basically-set elevation angle is 45 degrees for virtual rendering, and the virtual rendering is to be performed by decreasing the elevation angle to 35 degrees. In this case, a rendering panning coefficient to be applied to a virtual channel to be rendered and an ipsilateral output channel is increased, and a panning coefficient to be applied to residual channels is determined via power normalization.

For more specific description, it is assumed that a 22.2 input multichannel signal is to be reproduced via 5.1 output channels (speakers). In this case, from among 22.2 input channels, input channels to which the virtual rendering is applied and have elevation angles are nine channels that are CH_U_000(T0), CH_U_L45(TL45), CH_U_R45(TR45), CH_U_L90(TL90), CH_U_R90(TR90), CH_U_L135 (TL135), CH_U_R135(TR135), CH_U_180(T180), and CH_T_000(VOG), and the 5.1 output channels are five channels (except for a woofer channel) that are CH_M_000, CH_M_L030, CH_M_R030, C_M_L110, and CH_R_110 existing on a horizontal plane.

In this manner, in a case where the CH_U_L45 channel is rendered by using the 5.1 output channels, when the basically-set elevation angle is 45 degrees and the elevation angle is attempted to be decreased to 35 degrees, the panning coefficient to be applied to CH_M_L030 and CH_M_L110 that are ipsilateral output channels of the CH_U_L45 channel is updated to be increased by 3 dB, and the panning coefficient of residual three channels is updated to be decreased, so that $$\sum_{i=1}^{N} g_i = 1$$

is satisfied. Here, N indicates the number of output channels for rendering a random virtual channel, and $g_i$ indicates a panning coefficient to be applied to each output channel.

This process has to be performed on each of height input channel.

On the other hand, it is assumed that the basically-set elevation angle is 45 degrees for virtual rendering, and the virtual rendering is to be performed by increasing the elevation angle to 55 degrees. In this case, the rendering panning coefficient to be applied to a virtual channel to be rendered and an ipsilateral output channel is decreased, and the panning coefficient to be applied to residual channels is determined via power normalization.

When the CH_U_L45 channel is rendered by using the 5.1 output channels, if the basically-set elevation angle is increased from 45 degrees to 55 degrees, the panning coefficient to be applied to CH_M_L030 and CH_M_L110 that are the ipsilateral output channels of the CH_U_L45 channel is updated to be decreased by 3 dB, and the panning coefficient of the residual three channels is updated to be increased, so that $$\sum_{i=1}^{N} g_i = 1$$

is satisfied. Here, N indicates the number of output channels for rendering a random virtual channel, and $g_i$ indicates a panning coefficient to be applied to each output channel.

However, when the elevation is increased in the aforementioned manner, it is necessary not to reverse left and right sound images due to the update of the panning coefficient, and this is described with reference to FIG. 8.

Hereinafter, a method of updating a tone color filter coefficient will be described with reference to FIG. 11.

FIG. 11 illustrates characteristics of a tone color filter according to frequencies when an elevation angle of a channel is 35 degrees and an elevation angle is 45 degrees.

As illustrated in FIG. 11, it is apparent that a characteristic due to an elevation angle is highly noticeable in the tone color filter of the channel with the elevation angle of 45 degrees, compared to the tone color filter of the channel with the elevation angle of 35 degrees.

In a case where virtual rendering is performed to have an elevation angle greater than a reference elevation angle, when rendering is performed on the reference elevation angle, a more increase (an updated filter coefficient is increased to be greater than 1) occurs in a frequency band (where an original filter coefficient is greater than 1) whose magnitude is required to be increased, and a more decrease (the updated filter coefficient is decreased to be less than 1) occurs in a frequency band (where the original filter coefficient is less than 1) whose magnitude is required to be decreased.

When filter magnitude characteristics are expressed in a decibel scale, as shown in FIG. 11, the tone color filter has a positive value is shown in a frequency band where magnitude of an output signal is required to be increased, and has a negative value in a frequency band where magnitude of an output signal is required to be decreased. In addition, as apparent in FIG. 11, as an elevation angle is decreased, a shape of filter magnitude becomes flat.

When a height channel is virtually rendered by using a horizontal plane channel, as the elevation angle is decreased, the height channel has a tone color similar to a signal of a horizontal plane, and as the elevation angle is increased, a change in an elevation is significant, so that, as the elevation angle is increased, an effect according to the tone color filter is increased so that an elevation effect due to an increase in the elevation angle is emphasized. On the other hand, as the elevation angle is increased, the effect according to the tone color filter is decreased so that the elevation effect may be decreased.

Therefore, the update of the filter coefficient according to the change in the elevation angle is performed by updating the original filter coefficient by using a basically-set elevation angle and a weight based on an elevation angle to be actually rendered.

In a case where the basically-set elevation angle for virtual rendering is 45 degrees, and an elevation is decreased by performing rendering to 35 degrees lower than the basic elevation angle, coefficients corresponding to a filter of 45 degrees of FIG. 11 are determined as initial values and are required to be updated to coefficients corresponding to a filter of 35 degrees.

Therefore, in a case where it is attempted to decrease an elevation by performing rendering to 35 degrees that is the elevation angle lower than 45 degrees that is the basic elevation angle, the filter coefficient has to be updated so that a valley and floor of a filter according to a frequency band are modified to be more smooth than those of the filter of 45 degrees.

On the other hand, in a case where the basically-set elevation angle is 45 degrees, and an elevation is increased by performing rendering to 55 degrees higher than the basic elevation angle, the filter coefficient has to be updated so that a valley and floor of a filter according to a frequency band are modified to be more sharp than those of the filter of 45 degrees.

Figure 12:
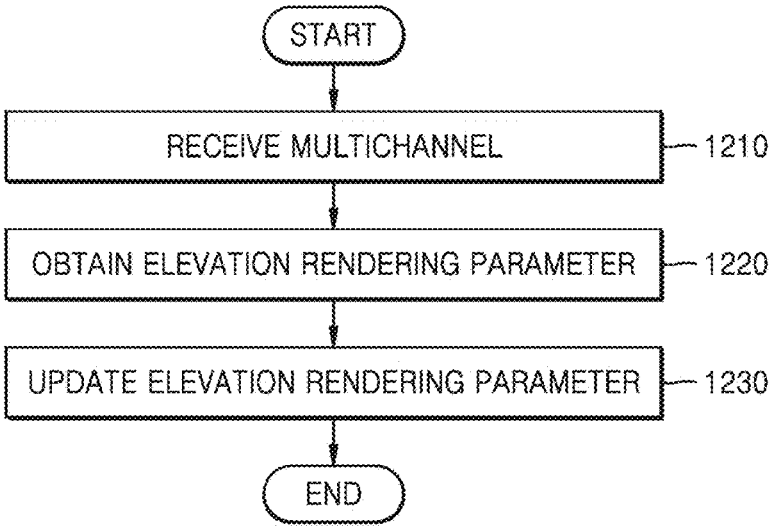
FIG. 12 is a flowchart of a method of rendering a 3D audio signal, according to an embodiment.

FIG. 12 is a flowchart of a method of rendering a 3D audio signal, according to an embodiment.

A renderer receives a multichannel audio signal including a plurality of input channels (1210). The input multichannel audio signal is converted to a plurality of output channel signals via rendering, and in a downmix example where the number of output channels is smaller than the number of input channels, an input signal having 22.2 channels is converted to an output channel having 5.1 channels.

In this manner, when a 3D audio input signal is rendered by using 2D output channels, general rendering is applied to input channels on a horizontal plane, and virtual rendering is applied to height channels each having an elevation angle so as to apply an elevation thereto.

In order to perform rendering, a filter coefficient to be used in filtering and a panning coefficient to be used in panning are required. Here, in an initialization process, a rendering parameter is obtained according to a standard layout of an output channel and a basically-set elevation angle for the virtual rendering (1220). The basically-set elevation angle may be variously determined according to the renderer, but when the virtual rendering is performed at a fixed elevation angle, satisfaction and an effect of the virtual rendering may be decreased according to user's preference or a characteristic of an input signal.

Therefore, when a configuration of an output channel has a deviation with respect to a standard layout of the output channel, or when an elevation at which the virtual rendering is to be performed is different from the basically-set elevation angle of the renderer, the rendering parameter is updated (1230).

Here, the updated rendering parameter may include a filter coefficient updated by adding, to an initial value of the filter coefficient, a weight determined based on an elevation angle deviation, or may include a panning coefficient updated by increasing or decreasing an initial value of a panning coefficient according to a result of comparing an elevation angle of an input channel with the basically-set elevation angle.

A detailed method of updating the filter coefficient and the panning coefficient is already described with reference to FIGS. 9 through 11, and thus descriptions are omitted. In this regard, the updated filter coefficient and the updated panning coefficient may be additionally modified or extended, and descriptions thereof will be provided in detail at a later time.

If a speaker layout of the output channel has a deviation with respect to the standard layout, a process for compensating for an effect due to the deviation may be added but descriptions of a detailed method thereof are omitted here. The deviation of the output channel may include deviation information according to a difference between elevation angles or azimuth angles.

Figure 13:
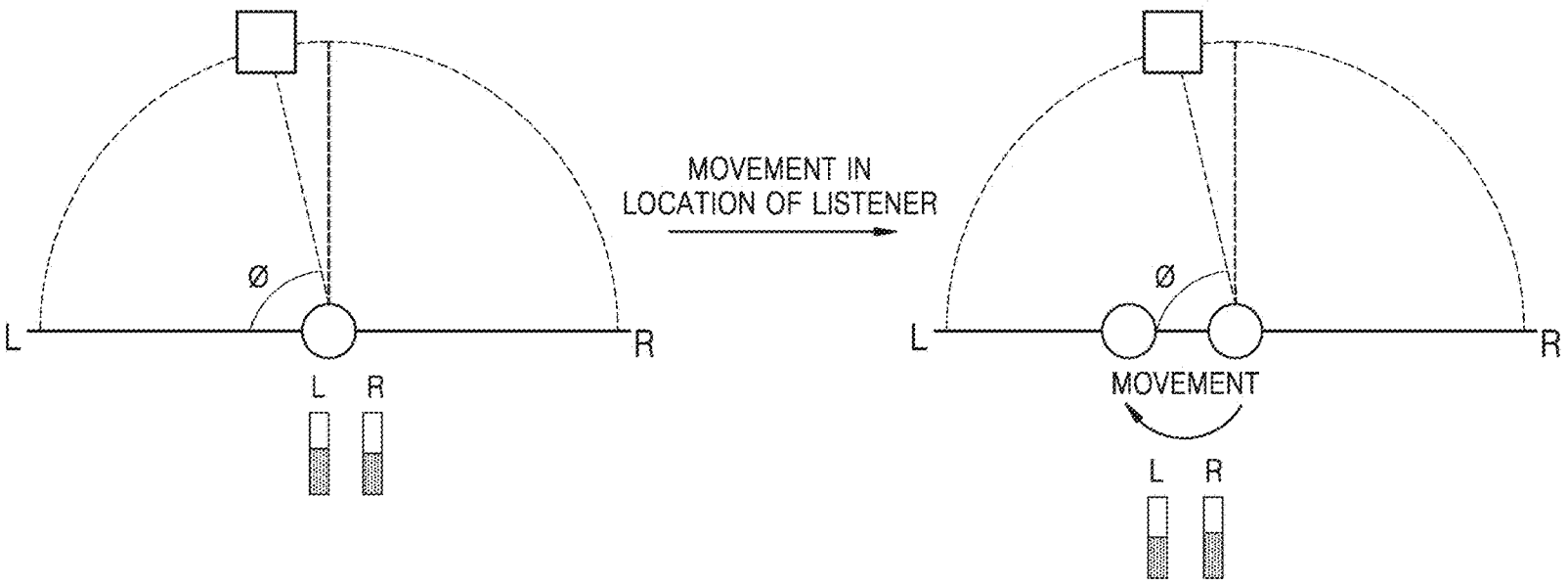
FIG. 13 illustrates a phenomenon where left and right sound images are reversed when an elevation angle of an input channel is equal to or greater than a threshold value, according to an embodiment.

FIG. 13 illustrates a phenomenon where left and right sound images are reversed when an elevation angle of an input channel is equal to or greater than a threshold value, according to an embodiment.

A person distinguishes between locations of sound images, according to time differences, level differences, and frequency differences of sounds that arrive at both ears of the person. When differences between characteristics of signals that arrive at both ears are great, the person may easily localize the locations, and even if a small error occurs, front-back confusion or left-right confusion with respect to the sound images does not occur. However, a virtual audio source located in a right rear side or right front side of a head has a very small time difference and a very small level difference, so that the person has to localize the location by using only a difference between frequencies.

As in FIG. 10, in FIG. 13, a square-shape channel is a CH_U_L90 channel in the rear side of a listener. Here, when an elevation angle of CH_U_L90 is $\varphi$, as $\varphi$ is increased, ILD and ITD of audio signals that arrive at a left ear and a right ear of the listener are decreased, and the audio signals perceived by both ears have similar sound images. A maximum value of the elevation angle $\varphi$ is 90 degrees, and when $\varphi$ is 90 degrees, the CH_U_L90 becomes a VOG channel existing above a head of the listener, thus, same audio signals are received via both ears.

As shown in a left diagram of FIG. 13, if $\varphi$ has a significantly great value, an elevation is increased so that the listener may feel a sound field feeling providing an intense immersive feeling. However, when the elevation is increased, a sound image becomes small and a sweet spot becomes small, such that, even if a location of the listener is slightly changed or a channel is slightly moved, a left-right reversal phenomenon may occur with respect to the sound image.

A right diagram of FIG. 13 illustrates locations of the listener and the channel when the listener slightly moved left. This is a case where an elevation is highly formed since the elevation angle $\varphi$ of the channel has a large value, thus, even if the listener slightly moves, relative locations of left and right channels are significantly changed, and in a worst case, although it is a left-side channel, a signal that arrives at the right ear is further significantly perceived, such that a left-right reversal of a sound image as shown in FIG. 13 may occur.

In a rendering process, it is more important to maintain a left and right balance of a sound image and to localize left and right locations of the sound image than to apply an elevation, thus, in order to prevent the aforementioned phenomenon, it may be necessary to limit an elevation angle for virtual rendering within a predetermined range.

Therefore, in a case where a panning coefficient is decreased when an elevation angle is increased to achieve a higher elevation than a basically-set elevation angle for rendering, it is necessary to set a minimum threshold value of the panning coefficient not to be equal to or lower than a predetermined value.

For example, even if a rendering elevation of 60 degrees is increased to be equal to or greater than 60 degrees, when panning is performed by compulsorily applying a panning coefficient that is updated with respect to a threshold elevation angle of 60 degrees, the left-right reversal phenomenon of the sound image may be prevented.

When 3D audio is generated by using virtual rendering, a front-back confusion phenomenon of an audio signal may occur due to a reproduction component of a surround channel. The front-back confusion phenomenon means a phenomenon by which it is difficult to determine whether a virtual audio source in the 3D audio is present in the front side or the back side.

With reference to FIG. 13, it is assumed that the listener moved, however, it is obvious to one of ordinary skill in the art that, as a sound image is increased, even if the listener does not move, there is a high possibility that the left-right confusion or the front-back confusion occurs due to a characteristic of an auditory organ of each person.

Hereinafter, a method of initializing and updating an elevation rendering parameter, i.e., an elevation panning coefficient and an elevation filter coefficient, will be described in detail.

When an elevation angle elv of a height input channel $i_{in}$ is greater than 35 degrees, if $i_{in}$ is a frontal channel (an azimuth angle is between −90 degrees through +90 degrees), an updated elevation filter coefficient $EQ_{SR}^{k}(eq(i_{in}))$ is determined according to Equations 1 through 3.

$$EQ_{1,db}^{k}(eq(i_{in}))=20\times\log_{10}(EQ_{0,lin}^{k}(eq(i_{in})))+0.05\times\log_{2}(f_k\times f_g/6000) \quad \text{[Equation 1]}$$

$$EQ_{2,db}^{k}(eq(i_{in}))=EQ_{1,db}^{k}(eq(i_{in}))\times(\min(\max(elv-35,0),25)\times 0.3) \quad \text{[Equation 2]}$$

$$EQ_{SR}^{k}(eq(i_{in}))=10^{(EQ_{2,db}^{k}(eq(i_{in})))/20-0.05\times log2(f_k\times f_g/6000)} \quad \text{[Equation 3]}$$

On the other hand, when the elevation angle elv of the height input channel $i_{in}$ is greater than 35 degrees, if $i_{in}$ is a rear channel (the azimuth angle is between −180 degrees through −90 degrees or 90 degrees through 180 degrees), the updated elevation filter coefficient $EQ_{SR}^{k}(eq(i_{in}))$ is determined according to Equations 4 through 6.

$$EQ_{1,db}^{k}(eq(i_{in}))=20\times\log_{10}(EQ_{0,lin}^{k}(eq(i_{in})))+0.07\times\log_{2}(f_k\times f_s/6000) \quad \text{[Equation 4]}$$

$$EQ_{2,db}^{k}(eq(i_{in}))=EQ_{1,db}^{k}(eq(i_{in}))\times(\min(\max(elv-35,0),25)\times 0.3) \quad \text{[Equation 5]}$$

$$EQ_{SR}^{k}(eq(i_{in}))=10^{(EQ_{2,db}^{k}(eq(i_{in})))/20-0.07\times log2(f_k\times f_g/6000)} \quad \text{[Equation 6]}$$

where, $f_k$ is a normalized center frequency of a $k^{th}$ frequency band, fs is a sampling frequency, and $E_{0,lin}^{k}(eq(i_{in}))$ is an initial value of the elevation filter coefficient at a reference elevation angle.

When an elevation angle for elevation rendering is not the reference elevation angle, an elevation panning coefficient with respect to height input channels except for the TBC channel (CH_U_180) and the VOG channel (CH_T_000) have to be updated.

When the reference elevation angle is 35 degrees and $i_{in}$ is the TFC channel (CH_U_000), the updated elevation panning coefficients $G_{vH,S}(i_{in})$ and $G_{vH,6}(i_{in})$ are determined according to Equations 7 and 8, respectively.

$$G_{vH,5}(i_{in})=10^{(0.25\times min(max(elv-35.0).25))/20}\times G_{vH0.5}(i_{in}) \quad \text{[Equation 7]}$$

$$G_{vH.6}(i_{in})=10^{(0.25\times min(max(elv-35.0).25))/20}\times G_{vH0.6}(i_{in}) \quad \text{[Equation 8]}$$

where, $G_{vH0.5}(i_{in})$ is a panning coefficient of an SL output channel for virtually rendering a TFC channel by using the reference elevation angle of 35 degrees, and $G_{vH0.6}(i_{in})$ is a panning coefficient of an SR output channel for virtually rendering the TFC channel by using the reference elevation angle of 35 degrees.

With respect to the TFC channel, it is impossible to adjust left and right channel gains so as to control an elevation, thus, a ratio of a gain with respect to the SL channel and the SR channel that are rear channels of the frontal channel is adjusted so as to control the elevation. Detailed descriptions are provided below.

With respect to other channels except for the TFC channel, when an elevation angle of a height input channel is greater than the reference elevation angle of 35 degrees, a gain of an ipsilateral channel of an input channel is decreased, and a gain of a contralateral channel of the input channel is increased, due to a gain difference between $g_I(elv)$ and $g_C(elv)$.

For example, when the input channel is a CH_U_L045 channel, an ipsilateral output channel of the input channel is CH_M_L030 and CH_M_L110, and a contralateral output channel of the input channel is CH_M_R030 and CH_M_R110.

Hereinafter, a method of obtaining $g_I(elv)$ and $g_C(elv)$ and updating an elevation panning gain therefrom, when an input channel is a side channel, a frontal channel, or a rear channel, will be described in detail.

When the input channel having an elevation angle elv is the side channel (an azimuth angle is between −110 degrees through −70 degrees or 70 degrees through 110 degrees), $g_I(elv)$ and $g_C(elv)$ are determined according to Equations 9 and 10, respectively.

$$g_I(elv)=10^{(-0.05522\times min(max(elv-35.0).25))/20} \quad \text{[Equation 9]}$$

$$g_C(elv)=10^{(0.41879\times min(max(elv-35.0).25))/20} \quad \text{[Equation 10]}$$

When the input channel having the elevation angle elv is the frontal channel (the azimuth angle is between −70 degrees through +70 degrees) or the rear channel (the azimuth angle is between −180 degrees through −110 degrees or 110 degrees through 180 degrees), $g_I(elv)$ and $g_C(elv)$ are determined according to Equations 11 and 12, respectively.

$$g_I(elv)=10^{(-0.047401\times min(max(elv-35.0).25))/20} \quad \text{[Equation 11]}$$

$$g_C(elv)=10^{(0.14985\times min(max(elv-35.0).25))/20} \quad \text{[Equation 12]}$$

Based on $g_I(elv)$ and $g_C(elv)$ calculated by using Equations 9 through and 12, the elevation panning coefficients may be updated.

An updated elevation panning coefficient $G_{vH,I}(i_{in})$ with respect to the ipsilateral output channel of the input channel, and an updated elevation panning coefficient $G_{vH,C}(i_{in})$ with respect to the contralateral output channel of the input channel are determined according to Equations 13 and 14, respectively.

$$G_{vH,I}(i_{in})=g_I(elv)\times G_{vH0,I}(i_{in}) \quad \text{[Equation 13]}$$

$$G_{vH,C}(i_{in})=g_C(elv)\times G_{vH0,C}(i_{in}) \quad \text{[Equation 14]}$$

In order to constantly maintain an energy level of an output signal, the panning coefficients obtained by using Equations 13 and 14 are normalized according to Equations 15 and 16.

$$P_{G_{vH}}(i_{in})=\sqrt{\sum_{o=1}^{6} G_{vH,o}^{2}(i_{in})} \quad \text{[Equation 15]}$$

$$G_{vH,1\sim 6}(i_{in})=\frac{1}{P_{G_{vH}}}G_{vH,1\sim 6}(i_{in}) \quad \text{[Equation 16]}$$

In this manner, a power normalize process is performed so that a total sum of a square of the panning coefficients of the input channel becomes 1, and by doing so, an energy level of an output signal before the panning coefficients are updated and an energy level of the output signal after the panning coefficients are updated may be equally maintained.

In $G_{vH,I}(i_{in})$ and $G_{vH,C}(i_{in})$ an index H indicates that an elevation panning coefficient is updated only in a high frequency domain. The updated elevation panning coefficients of Equations 13 and 14 are applied only to a high frequency band, 2.8 kHz through 10 kHz bands. However, when the elevation panning coefficient is updated with respect to a surround channel, the elevation panning coefficient is updated not only with respect to the high frequency band but also with respect to a low frequency band.

When the input channel having the elevation angle elv is the surround channel (the azimuth angle is between −160 degrees through −110 degrees or 110 degrees through 160 degrees), an updated elevation panning coefficient $C_{vL,I}(i_{in})$ with respect to an ipsilateral output channel of the input channel in a low frequency band of 2.8 kHz or below, and an updated elevation panning coefficient $G_{vL,C}(i_{in})$ with respect to a contralateral output channel of the input channel are determined according to Equations 17 and 18, respectively.

$$G_{vL,I}(i_{in})=g_I(\text{elv})\times G_{vL0,I}(i_{in}) \quad \text{[Equation 17]}$$

$$G_{vL,C}(i_{in})=g_C(\text{elv})\times G_{vL0,C}(i_{in}) \quad \text{[Equation 18]}$$

As in the high frequency band, in order for the updated elevation panning gain of the low frequency band to constantly maintain an energy level of an output signal, the panning coefficients obtained by using Equations 15 and 16 are power normalized according to Equations 19 and 20.

$$P_{G_{vL}}(i_{in}) = \sqrt{\sum_{o=1}^{6} G_{vL,o}^2(i_{in})} \quad \text{[Equation 19]}$$

$$G_{vL,1\sim6}(i_{in}) = \frac{1}{P_{G_{vL}}} G_{vL,1\sim6}(i_{in}) \quad \text{[Equation 20]}$$

In this manner, the power normalize process is performed so that a total sum of a square of the panning coefficients of the input channel becomes 1, and by doing so, an energy level of an output signal before the panning coefficients are updated and an energy level of the output signal after the panning coefficients are updated may be equally maintained.

FIGS. 14 through 17 are diagrams for describing a method of preventing front-back confusion of a sound image, according to an embodiment.

Figure 14:
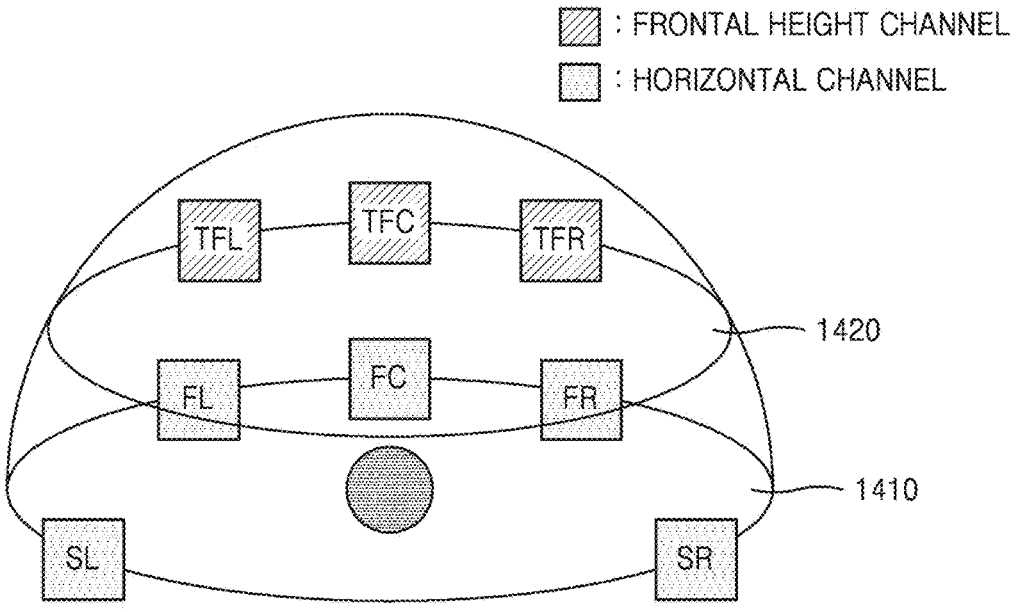
FIG. 14 illustrates horizontal channels and frontal height channels, according to an embodiment.

FIG. 14 illustrates horizontal channels and frontal height channels, according to an embodiment.

Referring to the embodiment shown in FIG. 14, it is assumed that an output channel is 5.0 channels (a woofer channel is now shown) and frontal height input channels are rendered to horizontal output channels. The 5.0 channels are present on a horizontal plane 1410 and include a Front Center (FC) channel, a Front Left (FL) channel, a Front Right (FR) channel, a Surround Left (SL) channel, and a Surround Right (SR) channel.

The frontal height channels are channels corresponding to an upper layer 1420 of FIG. 14, and in the embodiment shown in FIG. 14, the frontal height channels include a Top Front Center (TFC) channel, a Top Front Left (TFL) channel, and a Top Front Right (TFR) channel.

When it is assumed that, in the embodiment shown in FIG. 14, an input channel is 22.2 channels, input signals of 24 channels are rendered (downmixed) to generate output signals of 5 channels. Here, components that respectively correspond to the input signals of the 24 channels are distributed in the 5 channel output signal according to a rendering rule. Therefore, the output channels, i.e., the Front Center (FC) channel, the Front Left (FL) channel, the Front Right (FR) channel, the Surround Left (SL) channel, and the Surround Right (SR) channel respectively include components corresponding to the input signals.

In this regard, the number of the frontal height channels, the number of the horizontal channels, azimuth angles, and elevation angles of height channels may be variously determined according to a channel layout. When the input channel is the 22.2 channels or 22.0 channels, the frontal height channel may include at least one of CH_U_L030, CH_U_R030, CH_U_L045, CH_U_R045, and CH_U_000. When the output channel is the 5.0 channels or 5.1 channels, the surround channel may include at least one of CH_M_L110 and CH_M_R110.

However, it is obvious to one of ordinary skill in the art that, even if input and output multiple channels do not match the standard layout, a multichannel layout may be variously configured according to an elevation angle and an azimuth angle of each channel.

When a height input channel signal is virtually rendered by using the horizontal output channels, a surround output channel acts to increase an elevation of a sound image by applying the elevation to sound. Therefore, when signals from the horizontal height input channels are virtually rendered to the 5.0 output channels that are the horizontal channels, the elevation may be applied and adjusted by output signals from the SL channel and the SR channels that are the surround output channels.

However, since the HRTF is unique to each person, a front-back confusion phenomenon may occur, in which a signal that was virtually rendered to the frontal height channel is perceived as it sounds in the rear side according to an HRTF characteristic of a listener.

Figure 15:
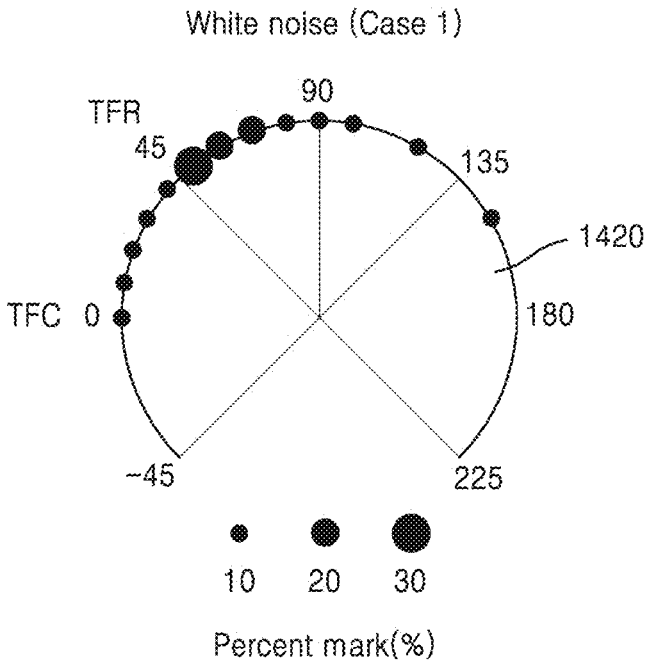
FIG. 15 illustrates a perception percentage of frontal height channels, according to an embodiment.

FIG. 15 illustrates a perception percentage of frontal height channels, according to an embodiment.

FIG. 15 illustrates a percentage that, when a frontal height channel, i.e., a TFR channel, is virtually rendered by using a horizontal output channel, a user localizes a location (front and rear) of a sound image. With reference to FIG. 15, a height recognized by the user corresponds to a height channel 1420 and a size of a circle is in proportion to a value of the possibility.

Referring to FIG. 15, although most users localize the sound image at 45 degrees on the right side which is a location of a virtually rendered channel, many users localize the sound image at another location rather than 45 degrees. As described above, this phenomenon occurs since the HRTF characteristic differs in people, it is possible to see that a certain user even localizes the sound image at the rear side further extending than 90 degrees on the right side.

The HRTF indicates a transfer path of audio from an audio source in a point in space adjacent to a head to an eardrum, which is mathematically expressed as a transfer function. The HRTF significantly varies according to a location of the audio source relative to a center of the head, and a size or shape of the head or pinna. In order to accurately portray a virtual audio source, the HRTFs of target people have to be individually measured and used, which is actually impossible. Thus, in general, a non-individualized HRTF measured by arranging a microphone at an eardrum position of a mannequin similar to a human body is used.

When the virtual audio source is reproduced by using the non-individualized HRTF, if a head or pinna of a person does not match the mannequin or a dummy head microphone system, various problems related to sound image localization occur. A deviation of localized degrees on a horizontal plane may be compensated for by taking into account a head size of a person, but since a size or shape of the pinna differs in people, it is difficult to compensate for a deviation of an elevation or a front-back confusion phenomenon.

As described above, each person has his/her own HRTF according to a size or shape of a head, however, it is actually difficult to apply different HRTFs to people, respectively. Therefore, the non-individualized HRTF, i.e., a common HRTF, is used, and in this case, the front-back confusion phenomenon may occur.

Here, when a predetermined time delay is added to a surround output channel signal, the front-back confusion phenomenon may be prevented.

Sound is not equally perceived by everyone and is differently perceived according to an ambient environment or a psychological state of a listener. This is because a physical event in space where the sound is delivered is perceived by the listener in a subjective and sensory manner. An audio signal that is perceived by a listener according to a subjective or psychological factor is referred to as psychoacoustic. The psychoacoustic is influenced by not only physical variables including an acoustic pressure, a frequency, a time, etc., but also affected by subjective variables including loudness, a pitch, a tone color, an experience with respect to sound, etc.

The psychoacoustic may have many effects according to situations, and for example, may include a masking effect, a cocktail effect, a direction perception effect, a distance perception effect, and a precedence effect. A technique based on the psychoacoustic is used in various fields so as to provide a more appropriate audio signal to a listener.

The precedence effect is also referred to as the Hass effect in which, when different sounds are sequentially generated by a time delay of 1 ms through 30 ms, a listener may perceive that the sounds are generated in a location where first-arriving sound is generated. However, if a time delay between generation times of two sounds is equal to or greater than 50 ms, the two sounds are perceived in different directions.

For example, when a sound image is localized, if an output signal of a right channel is delayed, the sound image is moved to the left and thus is perceived as a signal reproduced in the right side, and this phenomenon is called the precedence effect or the Hass effect.

A surround output channel is used to add an elevation to the sound image, and as illustrated in FIG. 15, due to a surround output channel signal, the front-back confusion phenomenon occurs such that some listeners may perceive that a frontal channel signal comes from a rear side.

By using the aforementioned precedence effect, the above problem may be solved. When a predetermined time delay is added to the surround output channel signal to reproduce a frontal height input channel, compared to signals from frontal output channels which are present at −90 degrees through +90 degrees with respect to the front and are from among output signals for reproducing a frontal height input channel signal, signals from surround output channels which are present at −180 degrees through −90 degrees or +90 degrees through +180 degrees with respect to the front are reproduced with a delay.

Accordingly, even if an audio signal from the frontal input channel may be perceived as it is reproduced in the rear side, due to a unique HRTF of a listener, the audio signal is perceived as it is reproduced in the front side where an audio signal is first reproduced according to the precedence effect.

Figure 16:
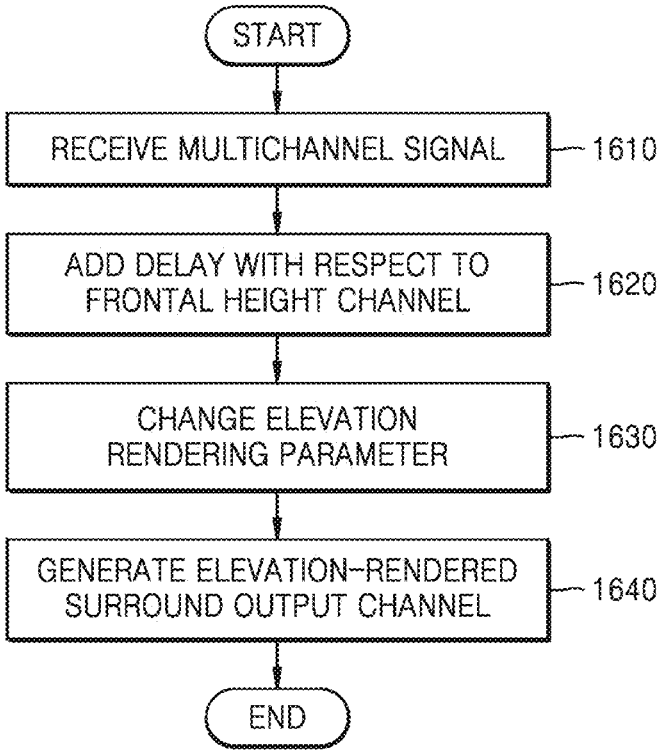
FIG. 16 is a flowchart of a method of preventing front-back confusion, according to an embodiment.

FIG. 16 is a flowchart of a method of preventing front-back confusion, according to an embodiment.

A renderer receives a multichannel audio signal including a plurality of input channels (1610). The input multichannel audio signal is converted to a plurality of output channel signals via rendering, and in a downmix example in which the number of output channels is smaller than the number of input channels, an input signal having 22.2 channels is converted to an output signal having 5.1 channels or 5.0 channels.

In this manner, when a 3D audio input signal is rendered by using a 2D output channel, general rendering is applied to input channels on a horizontal plane, and virtual rendering is applied to height channels each having an elevation angle so as to apply an elevation thereto.

In order to perform rendering, a filter coefficient to be used in filtering and a panning coefficient to be used in panning are required. Here, in an initialization process, a rendering parameter is obtained according to a standard layout of an output channel and a basically-set elevation angle for the virtual rendering. The basically-set elevation angle may be variously determined according to the renderer, and when a predetermined elevation angle, not the basically-set elevation angle, is set according to user's preference or a characteristic of an input signal, satisfaction and an effect of the virtual rendering may be improved.

In order to prevent the front-back confusion due to a surround channel, a time delay is added to a surround output channel with respect to a frontal height channel (1620).

When a predetermined time delay is added to the surround output channel signal to reproduce a frontal height input channel, compared to signals from frontal output channels which are present at 90 degrees through +90 degrees with respect to the front and are from among output signals for reproducing a frontal height input channel signal, signals from surround output channels which are present at −180 degrees through −90 degrees or +90 degrees through +180 degrees with respect to the front are reproduced with a delay.

Accordingly, even if an audio signal from the frontal input channel may be perceived as it is reproduced in the rear side, due to a unique HRTF of a listener, the audio signal is perceived as it is reproduced in the front side where an audio signal is first reproduced according to the precedence effect.

As described above, in order to reproduce the frontal height channel by delaying the surround output channel with respect to the frontal height channel, the renderer changes an elevation rendering parameter, based on a delay added to the surround output channel (1630).

When the elevation rendering parameter is changed, the renderer generates an elevation-rendered surround output channel, based on the changed elevation rendering parameter (1640). In more detail, rendering is performed by applying the changed elevation rendering parameter to a height input channel signal, so that a surround output channel signal is generated. In this manner, the elevation-rendered surround output channel that is delayed with respect to the frontal height input channel, based on the changed elevation rendering parameter, may prevent the front-back confusion due to the surround output channel.

The time delay applied to the surround output channel is preferably about 2.7 ms and about 91.5 cm in distance, which corresponds to 128 samples, i.e., two Quadrature Mirror Filter (QMF) samples in 48 kHz. However, in order to prevent the front-back confusion, the delay added to the surround output channel may vary according to a sampling rate and a reproduction environment.

Here, when a configuration of an output channel has a deviation with respect to a standard layout of the output channel, or when an elevation at which the virtual rendering is to be performed is different from the basically-set elevation angle of the renderer, the rendering parameter is updated. The updated rendering parameter may include a filter coefficient updated by adding, to an initial value of the filter coefficient, a weight determined based on an elevation angle deviation, or may include a panning coefficient updated by increasing or decreasing an initial value of a panning coefficient according to a result of comparing an elevation angle of an input channel with the basically-set elevation angle.

If the frontal height input channel to be spatially elevation-rendered is present, delayed QMF samples of the frontal input channel are added to an input QMF sample, and a downmix matrix is extended to a changed coefficient.

A method of adding a time delay to a frontal height input channel and changing a rendering (downmix) matrix is described in detail below.

When the number of input channels is Nin, with respect to an $i^{th}$ input channel from among [1 Nin] channels, if the $i^{th}$ input channel is one of height input channels CH_U_L030, CH_U_L045, CH_U_R030, CH_U_R045, and CH_U_000, a QMF sample delay of the input channel and a delayed QMF sample are determined according to Equation 21 and Equation 22.

$$\text{delay}=\text{round}(fs*0.003/64) \quad \text{[Equation 21]}$$

$$y_{ch}^{n,k}=[y_{ch}^{n,k}y_{ch,i}^{n-delay,k}] \quad \text{[Equation 22]}$$

where, fs indicates a sampling frequency, and $y_{ch}^{n,k}$ indicates an $n^{th}$ QMF sub-band sample of a $k^{th}$ band. The time delay applied to the surround output channel is preferably about 2.7 ms and about 91.5 cm in distance, which corresponds to 128 samples, i.e., two QMF samples in 48 kHz. However, in order to prevent the front-back confusion, the delay added to the surround output channel may vary according to a sampling rate and a reproduction environment.

The changed rendering (downmix) matrix is determined according to Equations 23 through 25.

$$M_{DMX}=[M_{DMX}M_{DMX,1-N_{out},1}] \quad \text{[Equation 23]}$$

$$M_{DMX2}=[M_{DMX2[00\ldots0]}^{T}] \quad \text{[Equation 24]}$$

$$\text{Nin}=\text{Nin}+1 \quad \text{[Equation 25]}$$

where, $M_{DMX}$ indicates a downmix matrix for elevation rendering, $M_{DMX}$ indicates a downmix matrix for general rendering, and Nout indicates the number of output channels.

In order to complete the downmix matrix for each of input channels, Nin is increased by 1 and a procedure of Equation 3 and Equation 4 is repeated. In order to obtain a downmix matrix with respect to one input channel, it is required to obtain downmix parameters for output channels.

The downmix parameter of a $j^{th}$ output channel with respect to an $i^{th}$ input channel is determined as below.

When the number of output channels is Nout, with respect to a $j^{th}$ output channel from among [1 Nout] channels, if the $j^{th}$ output channel is one of surround channels CH_M_L110 and CH_M_R110, the downmix parameter to be applied to the output channel is determined according to Equation 26.

$$M_{DMX,j,i}=0 \quad \text{[Equation 26]}$$

When the number of output channels is Nout, with respect to the $j^{th}$ output channel from among [1 Nout], if the $j^{th}$ output channel is not the surround channel CH_M_L110 or CH_M_R110, the downmix parameter to be applied to the output channel is determined according to Equation 27.

$$M_{DMX,j,Nin}=0 \quad \text{[Equation 27]}$$

Here, if a speaker layout of the output channel has a deviation with respect to the standard layout, a process for compensating for an effect due to the difference may be added but detailed descriptions thereof are omitted. The deviation of the output channel may include deviation information according to a difference between elevation angles or azimuth angles.

Figure 17:
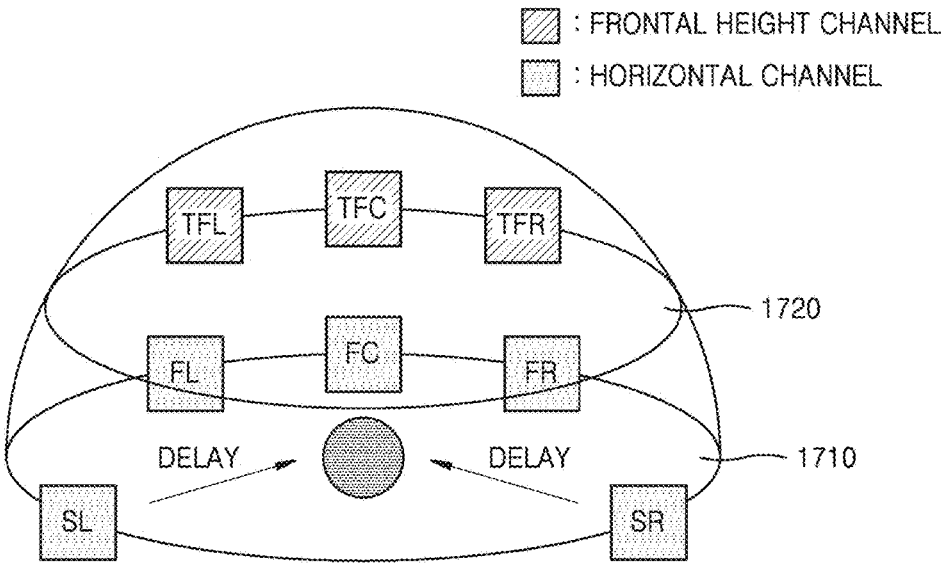
FIG. 17 illustrates horizontal channels and frontal height channels when a delay is added to surround output channels, according to an embodiment.

FIG. 17 illustrates horizontal channels and frontal height channels when a delay is added to surround output channels, according to an embodiment.

In the embodiment of FIG. 17, likewise to the embodiment of FIG. 14, it is assumed that an output channel is 5.0 channels (a woofer channel is now shown) and frontal height input channels are rendered to horizontal output channels. The 5.0 channels are present on the horizontal plane 1410 and include a Front Center (FC) channel, a Front Left (FL) channel, a Front Right (FR) channel, a Surround Left (SL) channel, and a Surround Right (SR) channel.

The frontal height channels are channels corresponding to the upper layer 1420 of FIG. 14, and in the embodiment shown in FIG. 14, the frontal height channels include a Top Front Center (TFC) channel, a Top Front Left (TFL) channel, and a Top Front Right (TFR) channel.

In the embodiment of FIG. 17, likewise to the embodiment of FIG. 14, when it is assumed that an input channel is 22.2 channels, input signals of 24 channels are rendered (downmixed) to generate output signals of 5 channels. Here, components that respectively correspond to the input signals of the 24 channels are distributed in the 5 channel output signal according to a rendering rule. Therefore, the output channels, i.e., the FC channel, the FL channel, the FR channel, the SL channel, and the SR channel respectively include components corresponding to the input signals.

In this regard, the number of the frontal height channels, the number of the horizontal channels, azimuth angles, and elevation angles of height channels may be variously determined according to a channel layout. When the input channel is the 22.2 channels or 22.0 channels, the frontal height channel may include at least one of CH_U_L030, CH_U_R030, CH_U_L045, CH_U_R045, and CH_U_000. When the output channel is the 5.0 channels or 5.1 channels, the surround channel may include at least one of CH_M_L110 and CH_M_R110.

However, it is obvious to one of ordinary skill in the art that, even if input and output multiple channels do not match the standard layout, a multichannel layout may be variously configured according to an elevation angle and an azimuth angle of each channel.

Here, in order to prevent a front-back confusion phenomenon occurring due to the SL channel and the SR channel, a predetermined delay is added to the frontal height input channel that is rendered via the surround output channel. An elevation-rendered surround output channel that is delayed with respect to the frontal height input channel, based on a changed elevation rendering parameter, may prevent the front-back confusion due to the surround output channel.

The methods of obtaining the elevation rendering parameter changed based on a delay-added audio signal and an added delay are shown in Equations 1 through 7. As described in detail in the embodiment of FIG. 16, detailed descriptions thereof are omitted in the embodiment of FIG. 17.

The time delay applied to the surround output channel is preferably about 2.7 ms and about 91.5 cm in distance, which corresponds to 128 samples, i.e., two QMF samples in 48 kHz. However, in order to prevent the front-back confusion, the delay added to the surround output channel may vary according to a sampling rate and a reproduction environment.

Figure 18:
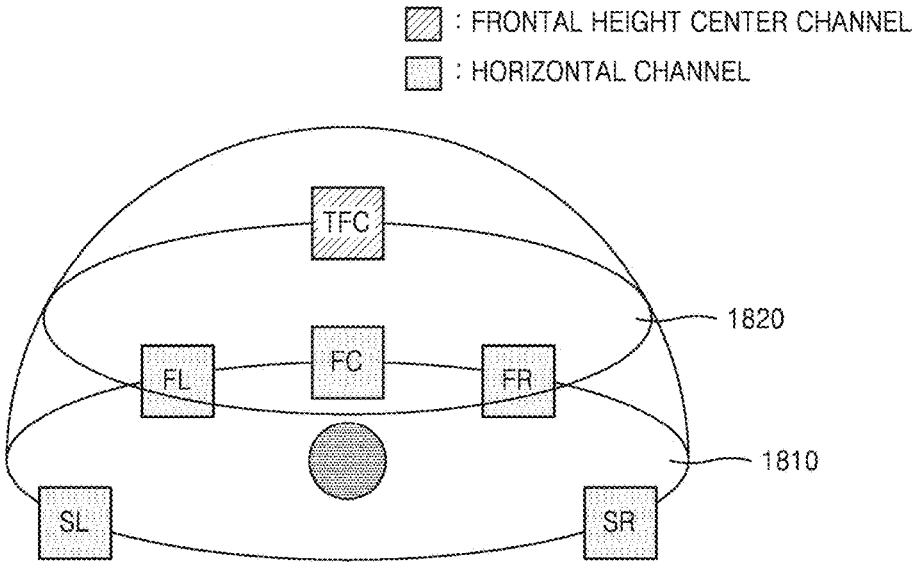
FIG. 18 illustrates a horizontal channel and a top front center (TFC) channel, according to an embodiment.

FIG. 18 illustrates a horizontal channel and a top front center (TFC) channel, according to an embodiment.

According to the embodiment shown in FIG. 18, it is assumed that an output channel is 5.0 channels (a woofer channel is now shown) and the top front center (TFC) channel is rendered to a horizontal output channel. The 5.0 channels are present on the horizontal plane 1810 and include a Front Center (FC) channel, a Front Left (FL) channel, a Front Right (FR) channel, a Surround Left (SL) channel, and a Surround Right (SR) channel. The TFC channel corresponds to an upper layer 1820 of FIG. 18, and it is assumed that the TFC channel has 0 azimuth angle and is located with a predetermined elevation angle.

As described above, it is very important to prevent a left-right reversal of a sound image when the audio signal is rendered. In order to render a height input channel having an elevation angle to a horizontal output channel, it is required to perform virtual rendering, and multichannel input channel signals are panned to multichannel output signals via rendering.

For the virtual rendering that provides an elevated feeling at a particular elevation, a panning coefficient and a filter coefficient are determined, and in this regard, for a TFT channel input signal, a sound image has to be located in front of a listener, i.e., at the center, thus, panning coefficients of the FL channel and the FR channel are determined to make the sound image of the TFC channel located at the center.

In a case where a layout of output channels matches a standard layout, the panning coefficients of the FL channel and the FR channel have to be identical, and panning coefficients of the SL channel and the SR channel also have to be identical.

As described above, since the panning coefficients of left and right channels for rendering the TFC input channel have to be identical, it is impossible to adjust the panning coefficients of the left and right channels so as to adjust an elevation of the TFC input channel. Therefore, panning coefficients among front and rear channels are adjusted so as to apply an elevated feeling by rendering the TFC input channel.

When a reference elevation angle is 35 degrees, and an elevation angle of the TFC input channel to be rendered is elv, the panning coefficients of the SL channel and the SR channel for virtually rendering the TFC input channel to the elevation angle elv are respectively determined according to Equation 28 and Equation 29.

$$G_{vH,5}(i_{in})=10^{(0.25\times min(max(elv-35.0),25))/20}\times G_{VH0.5}(i_{in}) \quad \text{[Equation 28]}$$

$$G_{vH,6}(i_{in})=10^{(0.25\times min(max(elv-35.0),25))/20}\times G_{vH0.6}(i_{in}) \quad \text{[Equation 29]}$$

where, $G_{vH0.5}(i_{in})$ is the panning coefficient of the SL channel for performing the virtual rendering at the reference elevation angle is 35 degrees, and $G_{vH0.6}(i_{in})$ is the panning coefficient of the SR channel for performing the virtual rendering at the reference elevation angle is 35 degrees. is an index with respect to a height input channel, and Equation 28 and Equation 29 each indicate a relation between an initial value of the panning coefficient and an updated panning coefficient when the height input channel is the TFC channel.

Here, in order to constantly maintain an energy level of an output signal, the panning coefficients obtained by using Equation 28 and Equation 29 are not changelessly used but are power normalized by using Equation 30 and Equation 31 and then are used.

$$P_{G_{vH}}(i_{in})=\sqrt{\sum_{o=1}^{6} G_{vH,o}^{2}(i_{in})} \quad \text{[Equation 30]}$$

$$G_{vH,1\sim6}(i_{in})=\frac{1}{P_{G_{vH}}}G_{vH,1\sim6}(i_{in}) \quad \text{[Equation 31]}$$

In this manner, the power normalize process is performed so that a total sum of a square of the panning coefficients of the input channel becomes 1, and by doing so, the energy level of the output signal before the panning coefficients are updated and the energy level of the output signal after the panning coefficients are updated may be equally maintained.

The embodiments according to the present invention can also be embodied as programmed commands to be executed in various computer configuration elements, and then can be recorded to a computer readable recording medium. The computer readable recording medium may include one or more of the programmed commands, data files, data structures, or the like. The programmed commands recorded to the computer readable recording medium may be particularly designed or configured for the invention or may be well known to one of ordinary skill in the art of computer software fields. Examples of the computer readable recording medium include magnetic media including hard disks, magnetic tapes, and floppy disks, optical media including CD-ROMs, and DVDs, magneto-optical media including floptical disks, and a hardware apparatus designed to store and execute the programmed commands in read-only memory (ROM), random-access memory (RAM), flash memories, and the like. Examples of the programmed commands include not only machine codes generated by a compiler but also include great codes to be executed in a computer by using an interpreter. The hardware apparatus can be configured to function as one or more software modules so as to perform operations for the invention, or vice versa.

While the detailed description has been particularly described with reference to non-obvious features of the present invention, it will be understood by one of ordinary skill in the art that various deletions, substitutions, and changes in form and details of the aforementioned apparatus and method may be made therein without departing from the spirit and scope of the following claims.

Therefore, the scope of the present invention is defined not by the detailed description but by the appended claims, and all differences within the scope will be construed as being included in the present invention.

What is claimed is:

1. A method of elevation rendering an audio signal, the method comprising:

receiving multichannel signals including a height input channel signal;

obtaining first elevation rendering parameters for the multichannel signals;

obtaining a delayed height input channel signal by applying a predetermined delay to the height input channel signal if a label of the height input channel signal is one of frontal height channel labels;

obtaining second elevation rendering parameters based on labels of two output channel signals if the label of the height input channel signal is one of frontal height channel labels, wherein the labels of the two output channel signals are surround channel labels; and elevation rendering the multichannel signals and the delayed height input channel signal to output a plurality of output channel signals based on the first elevation rendering parameters and the second elevation rendering parameters if the label of the height input channel signal is one of frontal height channel labels, wherein the first and second elevation rendering parameters comprise at least one of panning gains and elevation filter coefficients, and wherein the plurality of output channel signals are horizontal channel signals.

2. The method of claim 1, wherein the frontal height channel labels comprise at least one of CH_U_L030, CH_U_R030, CH_U_L045, CH_U_R045, and CH_U_000.

3. The method of claim 1, wherein the surround channel labels comprise at least one of CH_M_L110 and CH_M_R110.

4. The method of claim 1, wherein the predetermined delay is determined based on a sampling rate of the multichannel signals.

5. The method of claim 4, the predetermined delay is determined based on an equation of delay=round($f_s$×0.003/64), wherein the fs is the sampling rate of the multichannel signals.

6. An apparatus for elevation rendering an audio signal, the apparatus comprising:

at least one processor configured to:

receive multichannel signals including a height input channel signal;

obtain first elevation rendering parameters for the multichannel signals;

obtain a delayed height input channel signal by applying a predetermined delay to the height input channel signal if a label of the height input channel signal is one of frontal height channel labels;

obtain second elevation rendering parameters based on labels of two output channel signals if the label of the height input channel signal is one of frontal height channel labels, wherein the labels of the two output channel signals are surround channel labels; and elevation render the multichannel signals and the delayed height input channel signal to output a plurality of output channel signals based on the first elevation rendering parameters and the second elevation rendering parameters if the label of the height input channel signal is one of frontal height channel labels, wherein the first and second elevation rendering parameters comprise at least one of panning gains and elevation filter coefficient, and wherein the plurality of output channel signals are horizontal channel signals.

7. The apparatus of claim 6, wherein the frontal height channel labels comprise at least one of CH_U_L030, CH_U_R030, CH_U_L045, CH_U_R045, and CH_U_000.

8. The apparatus of claim 6, wherein the surround channel labels comprise at least one of CH_M_L110 and CH_M_R110.

9. The apparatus of claim 6, wherein the predetermined delay is determined based on a sampling rate of the multichannel signals.

10. The apparatus of claim 9, the predetermined delay is determined based on an equation of delay=round($f_s$×0.003/64), wherein the fs is the sampling rate of the multichannel signals.

11. A non-transitory computer-readable recording medium having recorded thereon a computer program for executing the method of claim 1.

* * * * *